US007025177B1

(12) United States Patent
Yang et al.

(10) Patent No.: US 7,025,177 B1
(45) Date of Patent: Apr. 11, 2006

(54) ELEVATOR SYSTEM WITHOUT MACHINE

(75) Inventors: Sun Ho Yang, Kwachon (KR); Kye Young Lim, Sungnam (KR); Jong Hoon Park, Changwon (KR); Joon Tae Yeom, Koonpo (KR); Gwang Nam Lee, Anyang (KR); Jong Ho Suh, Changwon (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/474,121

(22) Filed: Dec. 29, 1999

(30) Foreign Application Priority Data

Jul. 19, 1999 (KR) ..... 99-29131

(51) Int. Cl.
*B66B 11/08* (2006.01)
*B66B 7/02* (2006.01)

(52) U.S. Cl. ..... 187/254; 187/264; 187/266; 187/406

(58) Field of Classification Search ..... 187/250, 187/251, 254, 255, 261, 262, 264, 265, 266, 187/406
See application file for complete search history.

(56) References Cited

U.S. PATENT DOCUMENTS

| | | | | |
|---|---|---|---|---|
| 483,203 | A * | 9/1892 | Bassett | 187/254 |
| 1,625,084 | A * | 4/1927 | Hymans | 187/266 |
| 3,101,130 | A * | 8/1963 | Bianca | 187/266 X |
| 4,664,230 | A * | 5/1987 | Olsen | 187/255 |
| 5,036,954 | A | 8/1991 | Haahtikivi et al. | |
| 5,429,211 | A | 7/1995 | Aulanko et al. | |
| 5,823,298 | A | 10/1998 | Aulanko et al. | |
| 5,845,745 | A * | 12/1998 | Lane | 187/406 X |
| 5,878,847 | A | 3/1999 | Mustalahti et al. | |
| 5,899,301 | A | 5/1999 | Aulanko et al. | |
| 6,193,018 | B1 * | 2/2001 | Schroder-Brumloop et al. | 187/266 |
| 6,230,844 | B1 * | 5/2001 | Latorre | 187/254 |
| 6,247,557 | B1 * | 6/2001 | Kobayashi et al. | 187/266 |
| 6,488,124 | B1 * | 12/2002 | Yasuda et al. | 187/254 |
| 6,598,707 | B1 * | 7/2003 | Nakagaki et al. | 187/256 |

FOREIGN PATENT DOCUMENTS

| | | | | |
|---|---|---|---|---|
| EP | 415218 | A1 * | 3/1991 | 187/266 |
| EP | 599364 | A1 * | 3/1994 | 187/266 |
| JP | 08-208152 | A | 8/1996 | |
| JP | 11-060117 | A | 3/1999 | |
| JP | 0450297 | | 5/1999 | |

* cited by examiner

*Primary Examiner*—Eileen D. Lillis
*Assistant Examiner*—Thuy V. Tran
(74) *Attorney, Agent, or Firm*—Birch, Stewart, Kolasch & Birch, LLP

(57) ABSTRACT

An elevator system without a machine room is disclosed. In this elevator system without a machine room according to the present invention, a built-in winding apparatus is installed in the interior of a hoistway for moving an elevator car. In addition, the elevator system without a machine room according to the present invention is characterized in that a movement stroke of a counterweight is shorter than a movement stroke of an elevator car, and a reinforcing installation member is installed across an upper portion of a pair of counterweight guide rails which corresponds to an upper counterweight moving distance, and a pair of counterweight guide rails are integral with the reinforcing installation member, and the built-in winding apparatus is installed on the reinforcing installation member in such a manner that the elevator car is moved by a driving force transferred by a motor roping unit.

26 Claims, 28 Drawing Sheets

ELEVATOR SYSTEM WITHOUT MACHINE

BACKGROUND OF THE INVENTION

1. Field of the Invention

The present invention relates to an elevator system without a machine room, and in particular to an improved elevator system without a machine room which is capable of enhancing an adaptability of a design and installation and a durability with respect to a load and vibration and implementing an easier maintenance by installing a thin type winding machine in the interior of a hoistway and removing a machine room which is installed on the top of the hoistway in the conventional art.

2. Description of the Background Art

An elevator system is used for rapidly moving people or freight between floors of a building. As society is industrialized, the elevator system is necessarily installed in buildings. In addition, the elevator system is used for various purposes in the industry.

As the use of the elevator system is increased, a user needs a better performance of an elevator system. Currently, the elevator system is intensively studied on a speed, capacity boarding-on feel, durability, etc. In particular, in a view of loading people therein, a safety problem attracts a big attention from many people. In many countries, there is a very strict rule for the safety of the elevator system for thereby implementing a stable elevator system.

When installing an elevator system, a building owner has various installation methods. Generally, the building owner wishes to install an elevator system based on a good price compatibility, good durability, easier maintenance, and short construction period. Many elevator system fabrication companies have studied the elevator system based on the above-described trends.

In a conventional typical elevator system, an elevator car is suspended in a hoistway by a wire rope, and a left and right movement of the elevator car is prevented by a guide rail. A machine room is installed at the top of a building. A winding sheave connected with a motor, control panel, etc. are installed the machine room. The rope connects the winding sheave and a counterweight along a groove of a pulley which is additionally installed. The counterweight compensates the counterweight of the elevator car so that a motor unit effectively drives corresponding elements of the elevator system. The counterweight is guided by a counterweight guide rail for thereby preventing a left and right movement of the same.

In addition, in a case of a high building, in order to overcome a unbalance between the elevator car and the counterweight, a compensation rope is connected between the elevator car and a lower portion of the counterweight for thereby compensating an eccentric load of the counterweight of the wire rope.

In the above-described elevator system, a 1:1 roping method is directed to connecting the elevator car and the counterweight using a rope for thereby transferring a driving operation of the winding sheave based on a 1:1 method.

In a 2:1 roping method, a pulley is not installed at an elevator car and counterweight, respectively, and a rope is not directly connected with the elevator car and the counterweight. In this roping method, the rope is connected with an upper portion of a building through the pulleys, so that the elevator car and counterweight are lifted and lowered by the half of the length of the rope when the winding sheave is rotated. Therefore, the motor unit is driven at a 2-times speed compared to that of the 1:1 roping method, so that a rotation torque becomes half.

In the above-described elevator system, the control panel controls an electric power supplied to the motor unit and a rotation speed and rotation torque. When the motor unit is rotated, the winding sheave fixed at a shaft of the motor unit is rotated, and the rope wound onto a groove of the winding sheave is moved in a certain direction by a friction, so that the elevator car is lifted and lowered based on the moving direction of the rope.

In the elevator system, Since the elevator car is pulled using a rope at the top of the elevator system, the winding apparatus must be installed at the top of the hoistway. In addition, in order to protect the machine room from other surrounding environments, the machine room is separately installed, and the winding apparatus and control panel are installed in the interior of the machine room.

As an example of the above-described conventional elevator system, in the Japan utility Model Pyung 4-50297 (Title: Small elevator), the driving apparatus of the elevator car is installed at a mount fixed at the guide rail. Since the driving apparatus is positioned at a height same as the height of a ceiling of the elevator car and is housed in the interior of the hoistway and is protruded at the upper portion of the hoistway or from the hoistway, so that the machine room is not needed for installing the driving apparatus therein. Therefore, in this case, the above-described small elevator is proper to a small size house. In addition, a compact elevator may be available.

In the above-described conventional small elevator, a guide rail is installed from a lower portion to an upper portion of the hoistway for guiding the cage, and a counterweight guide rail is installed from a lower portion to a lower portion of the upper portion of the hoist way, so that it is possible to obtain a certain space for installing the driving apparatus between the mount fixed at the upper portion of the counterweight guide rail and the ceiling surface of the hoistway. Since a decelerating and winding apparatus which are a typical driving apparatus for driving the elevator car is installed in the installation space, it is not needed to additionally install a machine room at the upper or side portion of the hoistway, so that the small elevator is proper to a small house.

In the above-described elevator system, since a small capacity deceleration motor and sheave are installed in an installation space formed between the ceiling surface of the hoistway and the upper mount of the counterweight guide rail, the small elevator is proper to a small house for servicing passenger smaller than 6. The above-described small elevator is not applicable for an intermediate size elevator system and a large size elevator system which serve a large number of the passenger. In addition, since a space formed at an upper portion of the hoistway is small, there is a limit for installing the driving apparatus therein, and the selection of the winding apparatus is limited. In the typical elevator system in which a sheave is engaged at the shaft of the decelerating motor, and a rope is wound onto the sheave for thereby driving the elevator car, in the case that the number of passenger is increased, the sizes of the decelerating motor and sheave are increased, so that it is impossible to separately install the machine room at an upper portion of the hoistway or an outer portion of the same in the known manner.

As another example of the conventional elevator system, in the U.S. Pat. No. 5,036,954 (Title: Elevator), in the elevator which includes an elevator car, a guide rail for moving a counterweight therealong, a rope for suspending the car and counterweight, a sheave for moving the car and counterweight using the rope, and an elevator hoistway, the length of the rail used for moving the counterweight is shorter than that of the rail for moving the elevator car, and the guide rail for the counterweight is positioned at an upper portion of the hoistway.

In the above-described elevator system, the distance of the movement of the counterweight is shorter than the distance of the movement of the elevator car, and the ratio between the cross-sectional area of the elevator car and the cross-sectional area of the hoistway is increased. Therefore, it is possible to use the space formed below the counterweight. Since the guide rail for guiding the movement of the counterweight is installed at an intermediate upper portion of the hoistway, a certain support member is needed for stably supporting the lower portion of the guide rail in the intermediate space portion of the hoistway. Therefore, it is difficult to install in the interior of the narrow hoistway. In addition, in a structure that the lower portion of the counterweight guide rail is not supported by a support member, namely, the lower portion of the same is suspended by the upper portion, and the side portions of the same is supported, the stability and durability are decreased.

In the above-described elevator system, the driving apparatus is installed in an upper space portion of the hoistway spaced-apart from the upper portion of the counterweight guide rail. In this case, since the driving apparatus of the winding apparatus formed of a deceleration motor and a sheave is installed in the interior of the hoistway, the selectability and adaptability of the design are decreased for adapting to a large capacity elevator system.

In the U.S. Pat. No. 5,429,211 (Title: Traction sheave elevator), there are provided an elevator car moving along the guide rail, a counterweight moving along a counterweight guide rail, a hoisting rope set for suspending the elevator car and the counterweight, and a driving machine unit formed of a traction sheave driven by the driving machine unit and connected with the hoist rope. The driving machine unit of the elevator is installed on the top of the hoistway between the moving way of the elevator car or the extended portion thereof and the hoistway needed for the movement of the elevator car.

Since the above-described traction sheave elevator is installed in an upper space portion formed so that the winding apparatus of the driving machine unit is position higher than the elevator car when the elevator car is positioned at the highest portion, the installation space of the floor is increased. In addition, since the winding apparatus is fixedly installed by a support apparatus at the upper side space portion of the hoistway spaced-apart from the guide rail, the installation structure is complicated.

In the U.S. Pat. No. 5,823,298 (Title: Traction sheave elevator), the sheave elevator having a traction sheave and a driving machine is installed in a hoistway in which a guide rail is installed for guiding the movement of the elevator car and counterweight. The hoising rope is upwardly moved by the traction sheave. The above-described traction sheave elevator includes two conversion pulleys installed at an upper portion of the guide rail, and one conversion pulley is moved from the traction sheave to the elevator car, and the other conversion pulley moves a part of the hoisting rope from the traction sheave to the counterweight.

In the above-described traction sheave elevator, a winding apparatus is installed at an intermediate portion of the hoistway distanced from the elevator car guide rial and the counterweight guide rail. For example two conversion pulleys are engaged at an upper portion of the counterweight guide rail and are supported like a cantilever, and a traction rope is wound onto a winding apparatus of the intermediate portion and an upper conversion pulley and then is connected with the elevator car and the counterweight, and both ends of the traction rope is connected with an upper wall of the hoistway and an upper portion of the counterweight guide rail. A traction load of the rope applied to the pulley by the driving force of the winding apparatus is applied in a certain direction, so that the stability and durability are decreased. Since the winding apparatus is distanced from the guide rail and is fixed at an intermediate wall portion of the hoistway, the selectability and applicability of the design of the cross section of the hoistway are decreased.

In the U.S. Pat. No. 5,878,847 (Title: Arrangement for fixing an elevator rope), at least one end point of the elevator rope is connected with the elevator car guide rail and the counterweight guide rail, and the elevator car is suspended by the rope, so that all vertical direction loads are applied to the bottom of the hoistway by the elevator car guide rail and counterweight guide rail.

In the above-described rope arrangement for fixing the elevator rope, it is possible to easily install the elevator, and since all vertical direction loads are transferred to the bottom of the hoist way, the structure of the hoistway wall becomes light.

However, in the above-described rope arrangement, since there are provided a pulley at an upper portion of the guide rail, a winding apparatus, and other elements, the construction of the upper portion of the hoistway is complicated, and the length of the hoistway is increased. In addition, since a heavy apparatus such as the winding apparatus, other elements, etc. is installed at an upper portion of each guide rail like a cantilever, the vibration of the guide rail is increased, so that the durability is decreased, and vibration noise is increased.

In the U.S. Pat. No. 5,899,301 (Title: Elevator machinery mounted on a guide rail and its installation), an elevator machine having a disk type motor (hereinafter called as a disk type winding apparatus) is installed at the elevator car guide rail or the counterweight guide rail, and the guide rail in which the disk type winding apparatus is installed is an element capable of increasing the machinery driving force of the disk type winding apparatus, and the vertical direction load applied to the traction sheave by the elevator rope passes through the guide rail through a rolling center of a bearing. The disk type winding apparatus includes a damping system for damping a movement and vibration.

In the above-described various elevator systems, a conventional typical elevator, namely, an elevator having a machine room at the top of the hoistway, requires more construction materials and workers for fabricating the machine room, and the size of the entire structure is increased.

In addition, the total counterweights of the elevator car, counterweight, and wire rope are supported by the winding apparatus, and the winding apparatus is supported on the bottom of the machine room. Therefore, the total counterweights are applied to the entire structure of the building. A building is designed based on the above-described total counterweights and a support structure and a load bearing wall, so that more material, time, and workers are requires, and there is a limit for determining an installation site of the elevator system.

A machine room is protruded on the top of the building, an external appearance of the building is bad, and there is a limit for designing the building.

In the case that there is a building height limit in a certain area, the height of the building is limited by the height of the machine room.

The elevator using a disk type winding apparatus is lighter than the typical winding apparatus which is formed of a deceleration motor and a sheave engaged to the shaft of the motor, and a smaller installation space is needed, and the maintenance cost is decreased.

The above-described disk type winding apparatus is a thin type capable of adapting the principle and type of a known motor and has a trademarked name of ECODISC (KONE Corporation, Finland). In the elevator system without a machine room, a machine room is installed on the top of the building, so that more fabrication cost is needed, and the external appearance of the building is very important. In the above-described U.S. Patents, a new elevator structure without a machine room and a new wire rope arrangement are disclosed.

In the above-described conventional elevator system without a machine room, since a disk type winding apparatus is installed at an upper portion of the elevator car guide rail or the counterweight guide rail, the vibration and swaying state are applied to the upper portion of the guide rails when the elevator car and counterweight are moved, so that noise is increased, and the durability is decreased.

SUMMARY OF THE INVENTION

Accordingly, it is an object of the present invention to provide an elevator system without a machine room which is capable of enhancing an adaptability of a design and installation and a durability with respect to a counterweight load and vibration by installing a thin type winding apparatus in the interior of a hoistway for thereby removing a machine room which is installed in the conventional art.

To achieve the above objects, there is provided an elevator system without a machine room according to a first embodiment of the present invention in which a built-in winding apparatus is installed in the interior of a hoistway for moving an elevator car, which elevator system is characterized in that a movement stroke of a counterweight is shorter than a movement stroke of an elevator car, and a reinforcing installation member is installed across an upper portion of a pair of counterweight guide rails which corresponds to an upper counterweight moving distance, and a pair of counterweight guide rails are integral with the reinforcing installation member, and the built-in winding apparatus is installed on the reinforcing installation member in such a manner that the elevator car is moved by a driving force transferred by a motor roping unit.

To achieve the above objects, there is provided an elevator system without a machine room according to a second embodiment of the present invention in which a built-in type winding apparatus is installed in the interior of a hoistway for driving an elevator car, which elevator system is characterized in that a pair of counterweight guider rails which guide and support the counterweight are shorter than a pair of elevator car guide rails which guide and support the elevator car, and the built-in winding apparatus is installed in an intermediate region between an upper region formed based on the lower surface of the elevator car when the elevator car arrives at the highest floor of the hoistway and a lower region formed based on the upper surface of the counterweight when the counterweight arrives at the lowest portion of the hoistway, so that the elevator car passes through the built-in winding apparatus and arrives at the highest floor.

To achieve the above objects, there is provided an elevator system without a machine room according to a third embodiment of the present invention in which a built-in winding apparatus is installed in the interior of a hoistway for moving an elevator car, which elevator system is characterized in that the elevator car is positioned at an intermediate portion of the hoistway, and the built-in winding apparatus is positioned in an installation region S2 of a front portion or a rear portion in the interior of the hoistway formed as a traveling marginal space, and the counterweight is positioned below the built-in winding apparatus, and a pair of elevator car guide rails guide and support both side intermediate portions at both sides of the hoistway, and a pair of counterweight guide rails guide and support the front and rear intermediate portions of the counterweight at front and rear portions of the counterweight.

To achieve the above objects, there is provided an elevator system without a machine room according to a fourth embodiment of the present invention in which a built-in type winding apparatus is installed in the interior of a hoistway for moving an elevator car, said elevator system without a machine room. The elevator system without a machine room comprises a construction in which a movement stroke of the counterweight is shorter than a movement stroke of the elevator car, and a reinforcing installation member is installed across the upper portion in the moving interval of the counterweight of the counterweight guide rails which guide and support the counterweight, and a pair of the counterweight guide rails integral with the reinforcing installation member, and the built-in-winding apparatus is installed on the reinforcing installation member for moving the elevator car by transferring a driving force by a motor roping unit, a construction in which the built-in winding apparatus is installed in an intermediate region between an upper region formed based on the lower surface of the elevator car when the elevator car arrives at the highest floor of the hoistway and a lower region formed based on the upper surface of the counterweight when the counterweight arrives at the lowest floor, so that the upper surface of the elevator car passes through the built-in winding apparatus and arrives at the highest floor, and a construction in which the elevator car is positioned at an intermediate portion of the hoistway, and the built-in winding apparatus is positioned at a front portion or a rear portion, and the counterweight is positioned below the built-in winding apparatus, and a pair of elevator car guide rails are installed for guiding and supporting both side intermediate portions of the elevator car at both sides of the hoistway, and a pair of counterweight guide rails are installed for guiding and supporting the front and rear intermediate portions of the counterweight at the front and rear portions of the counterweight.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 1 through 5 are views illustrating the construction of an elevator system without a machine room by cutting away a hoistway according to a first embodiment of the present invention, in which:

FIG. 1 is a perspective view of the same;

FIG. 2 is a perspective view illustrating a rope arrangement structure;

FIG. 3 is a front view of the same;

FIG. 4 is a side view of the same; and

FIG. 5 is a plan view of the same;

FIGS. 6 through 11 are views illustrating the construction of an elevator system without a machine room by cutting away a wall of a hoistway according to a second embodiment of the present invention, in which:

FIG. 6 is a perspective view of the same;

FIG. 7 is a perspective view illustrating a rope arrangement structure;

FIG. 8 is a front view of the same;

FIG. 9 is a side view of the same;

FIG. 10 is a plan view of the same; and

FIG. 11 is an enlarged view illustrating a motor unit;

FIGS. 12 through 17 are views illustrating the construction of an elevator system without a machine room by cutting away a wall of a hoistway according to a third embodiment of the present invention, in which:

FIG. 12 is a perspective view of the same;

FIG. 13 is a perspective view illustrating a rope arrangement structure;

FIG. 14 is a front view of the same;

FIG. 15 is a side view of the same;

FIG. 16 is a plan view of the same; and

FIG. 17 is an enlarged view of a motor unit;

FIGS. 18 through 23 are views illustrating the construction of an elevator system without a machine room by cutting away a wall of a hoistway according to a fourth embodiment of the present invention, in which:

FIG. 18 is a perspective view of the same;

FIG. 19 is a perspective view illustrating a rope arrangement structure;

FIG. 20 is a front view of the same;

FIG. 21 is a side view of the same;

FIG. 22 is a plan view of the same; and

FIG. 23 is an enlarged view of a motor unit;

FIGS. 24 through 28 are views illustrating the construction of an elevator system without a machine room by cutting away a wall of a hoistway according to a fifth embodiment of the present invention, in which:

FIG. 24 is a perspective view of the same;

FIG. 25 is a perspective view illustrating a rope arrangement structure;

FIG. 26 is a front view of the same;

FIG. 27 is a side view of the same; and

FIG. 28 is an enlarged view illustrating a motor unit.

DETAILED DESCRIPTION OF THE PREFERRED EMBODIMENTS

The embodiments of the present invention will be explained with reference to the accompanying drawings.

Figure 1:
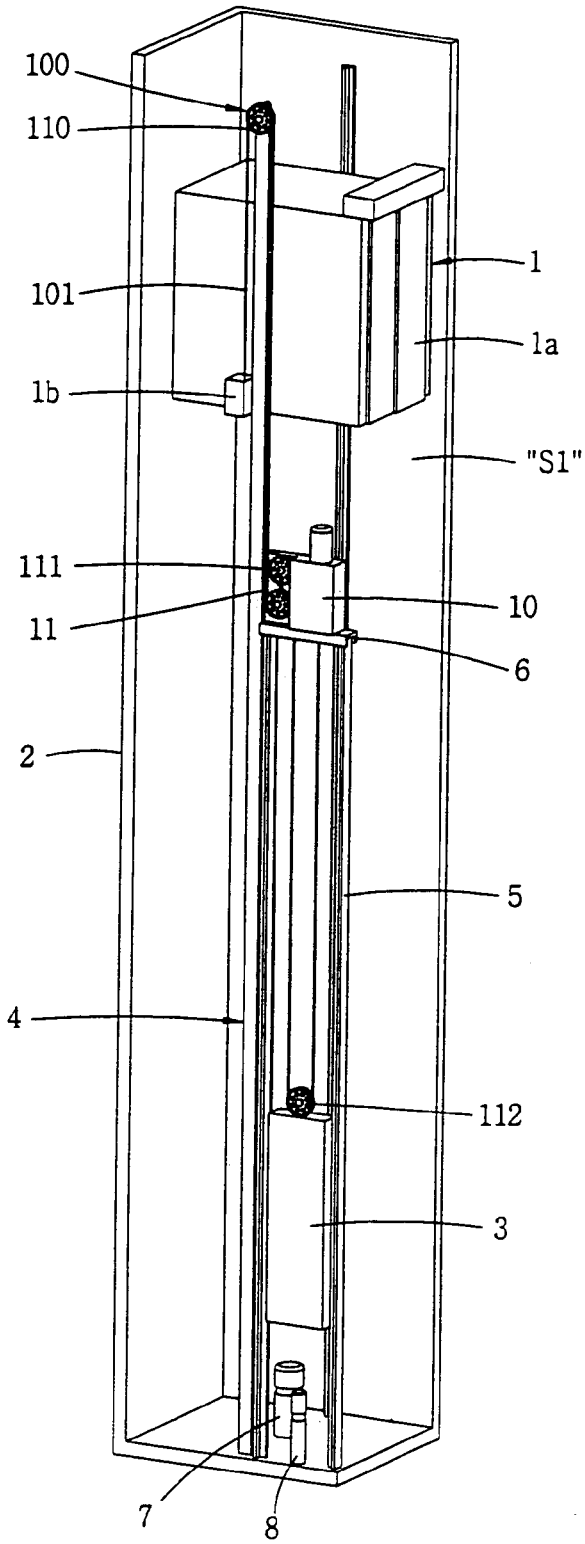
Figure 2:
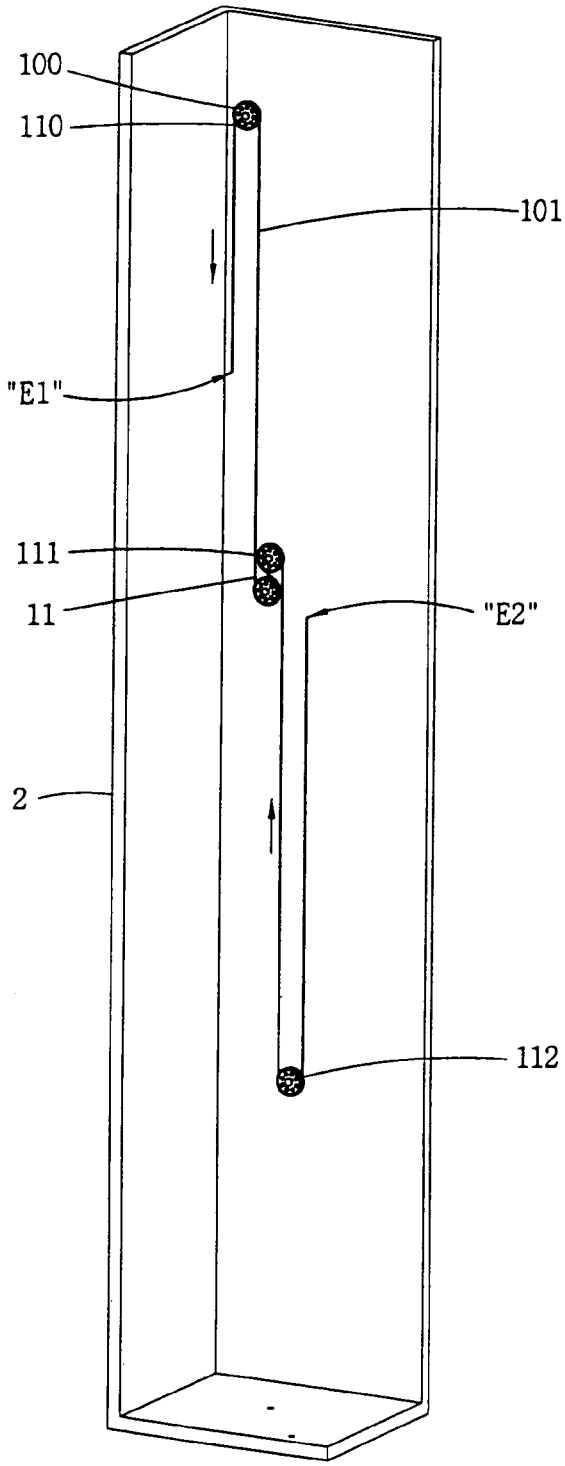
Figure 3:
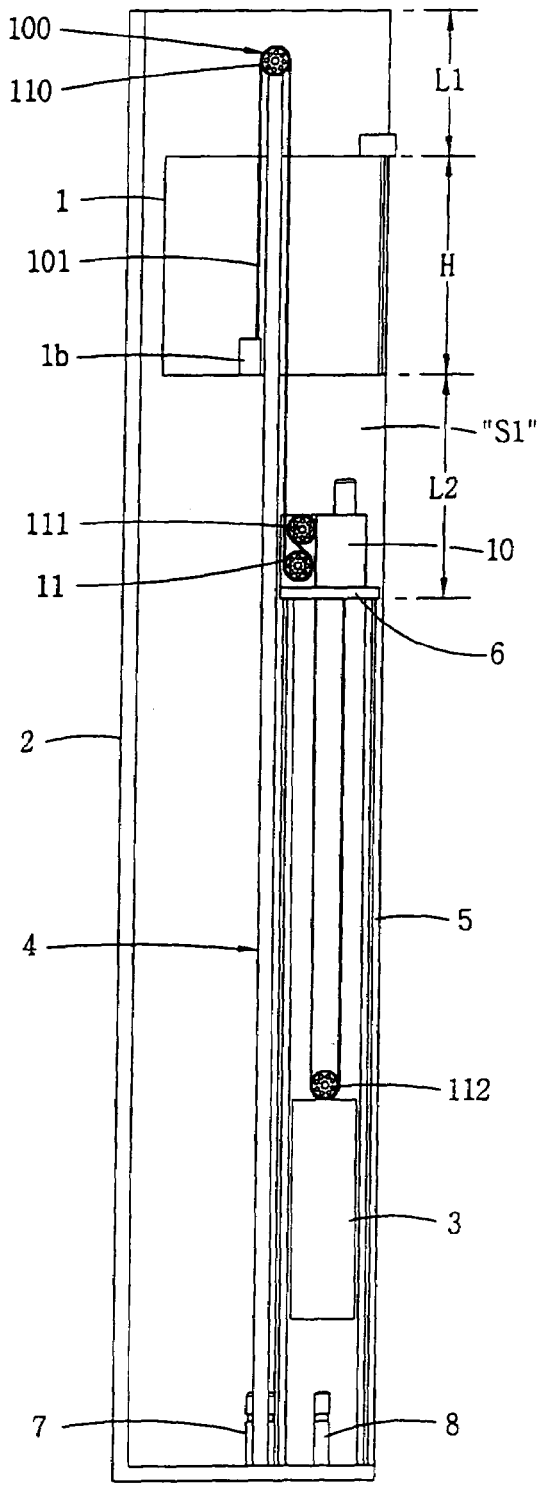
Figure 4:
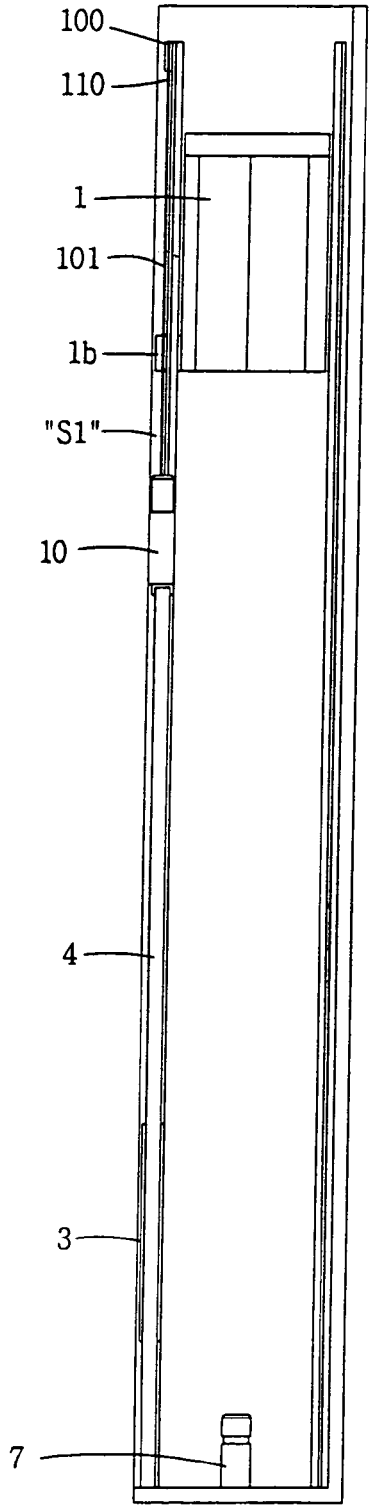
Figure 5:
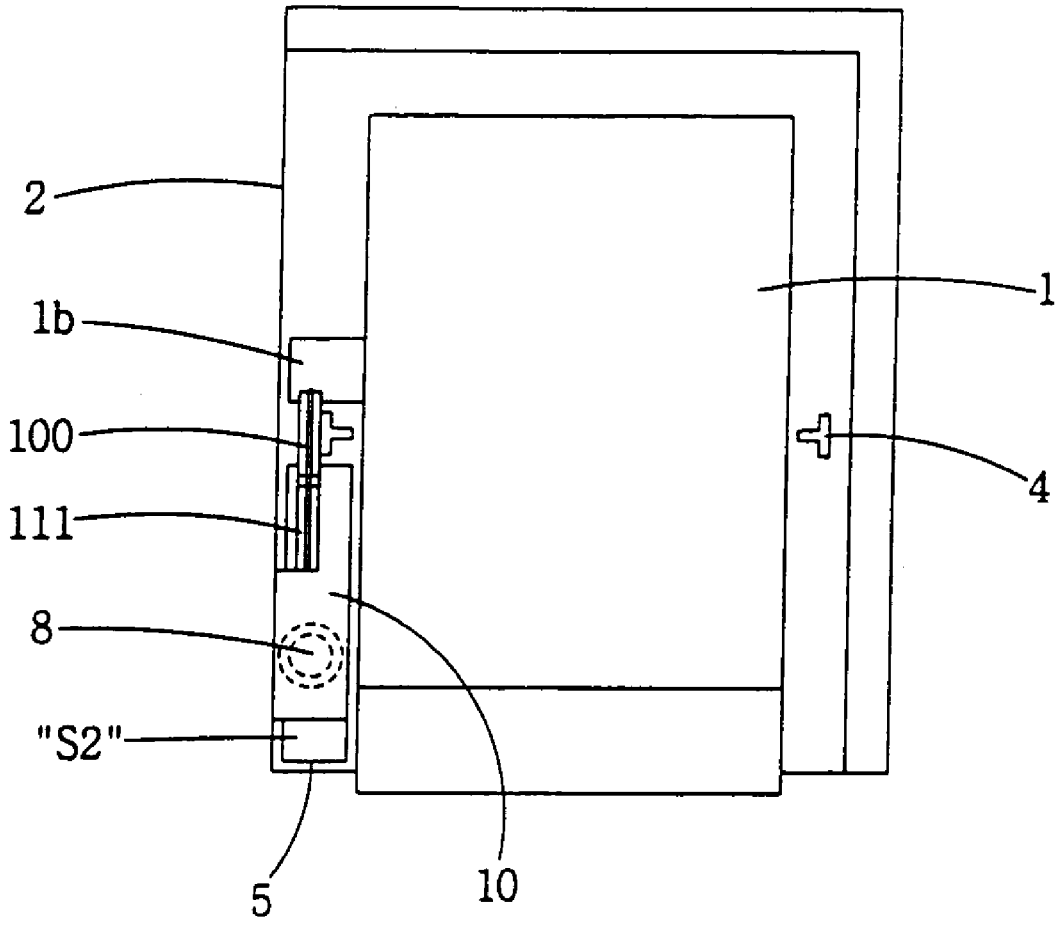

FIGS. 1 through 5 are views illustrating the construction of an elevator system without a machine room by cutting away a hoistway according to a first embodiment of the present invention, in which FIG. 1 is a perspective view of the same FIG. 2 is a perspective view illustrating a rope arrangement structure, FIG. 3 is a front view of the same, FIG. 4 is a side view of the same, and FIG. 5 is a plan view of the same.

In the drawings, reference numeral 1 represents an elevator car for carrying people or freight, 2 represents a hoistway in which the elevator car 1 is lifted and lowered in a building, and 3 represents a counterweight for compensating the counterweight of the elevator car 1. A pair of elevator guide rails 4 are installed at the bottom of the hoistway 2 for guiding the movement of the elevator car 1 from the bottom to the upper portion of the hoistway, and a pair of counterweight guide rails 5 are installed at the bottom of the hoistway 2 for guiding the movement of the counterweight 3 from the bottom of the hoistway 2 to an intermediate portion of the hoistway 2.

A reinforcing installation member 6 is installed across the upper portions of the counterweight guide rails 5, and the counterweight guide rails 5 are not separated from each other and are integral with the reinforcing installation member 6. A built-in type winding apparatus 10 is installed on the reinforcing installation member 6 for moving the elevator car 1.

Dampening units 7 and 8 are installed at the bottom of the hoistway 2 for damping the elevator car 1 and the counterweight 4 when the elevator car 1 and the counterweight 4 are moved down.

In addition, reference numeral 1*a* represents a door of the elevator car 1.

The counterweight guide rails 5 preferably have a shorter length compared to that of the elevator car guide rail 4. More preferably, the lengths of the counterweight guide rails 5 are shorter by the overall length H of the elevator car 1.

The built-in winding apparatus 10 is installed at an intermediate portion which is an intermediate space between an upper region which is an upper space based on a lower surface of the elevator car 1 when the elevator car 1 arrives at the highest floor of the hoistway 2 and a lower region which is a lower space based on an upper surface of the counterweight 3 when the counterweight 3 arrives at the lowest portion, so that the elevator car 1 arrives at the highest floor through the built-in winding apparatus 10.

For example, the counterweight guide rails 5 are installed so that the end portions of the same are positioned at a proper portion in the intermediate region. The upper end portion is positioned at a lower portion by the lower marginal length L2 compared to the elevator car 1 which is positioned at a portion lower by the upper marginal length L1 compared to the upper end portion of the elevator car guide rails 4.

Namely, the counterweight guide rails 5 have a length shorter by the overall length H+ upper marginal length L1+lower marginal length L2 of the elevator car 1 compared to that of the elevator car guide rails 4. The built-in winding apparatus 10 is installed at the reinforcing installation member-6 fixed at the upper ends of the counterweight guide rails 5 and on the lower surface of the elevator car 1 and in a marginal space S1 formed between the elevator car guide rails 4.

As the built-in type winding apparatus 10, a winding apparatus having a thin thickness such as an ECODISC may be used. Any thin type winding apparatus which may be installed in the interior of the hoistway 2 may be adapted.

As shown in FIG. 5, the elevator car 1 is positioned at an intermediate portion of the hoistway 2, and the built-in type winding apparatus 10 is installed at a front portion or a rear portion. The counterweight 3 is positioned below the built-in winding apparatus 10. In addition, the elevator car guide rails 4 are installed in such a manner that both intermediate portions of the elevator car 1 are guided and supported at both sides of the hoistway 2, and the counterweight guide rails 5 are installed in such a manner that the front and rear intermediate portions of the counterweight 3 are guided and supported at front and rear portions of the counterweight 3.

As an example, the elevator car guide rails 4 are installed at both side intermediate portions of the hoist way 2, and the counterweight guide rails 5 are installed in the front region S2 of the hoistway 2, and the elevator car guide rails 4 and the counterweight guide rails 5 are perpendicular each other.

A motor unit is formed of a pulley and a rope for driving the elevator car 1 and the counterweight 3 using the driving force of the built-in winding apparatus 10. The motor roping unit 100 is implemented based on a 1:2 roping method.

In the motor roping unit 100, an upper end point E1 becomes a lower side portion of the elevator car 1, and a lower end point E2 becomes the reinforcing installation member 6.

The motor roping unit 100 is connected with one end of the rope 101 at a fixing portion 1*b* provided at a lower portion of the elevator car 1. The rope 101 is moved upwardly and is wound onto an outer circumferential portion of the pulley 110 fixed at the upper end of the elevator car guide rail 4, and the pulley 111 is engaged at an upper portion of the driving sheave 11 of the built-in winding apparatus 10, and the rope 101 is wound in a S-shape on the driving sheave 11 and the pulley 111, and the pulley 112 is fixed at an upper portion of the counterweight 3, and the rope 101 is wound onto an outer lower portion of the pulley 112, and the rope 101 is fixed at the reinforcing installation member 6.

Figure 6:
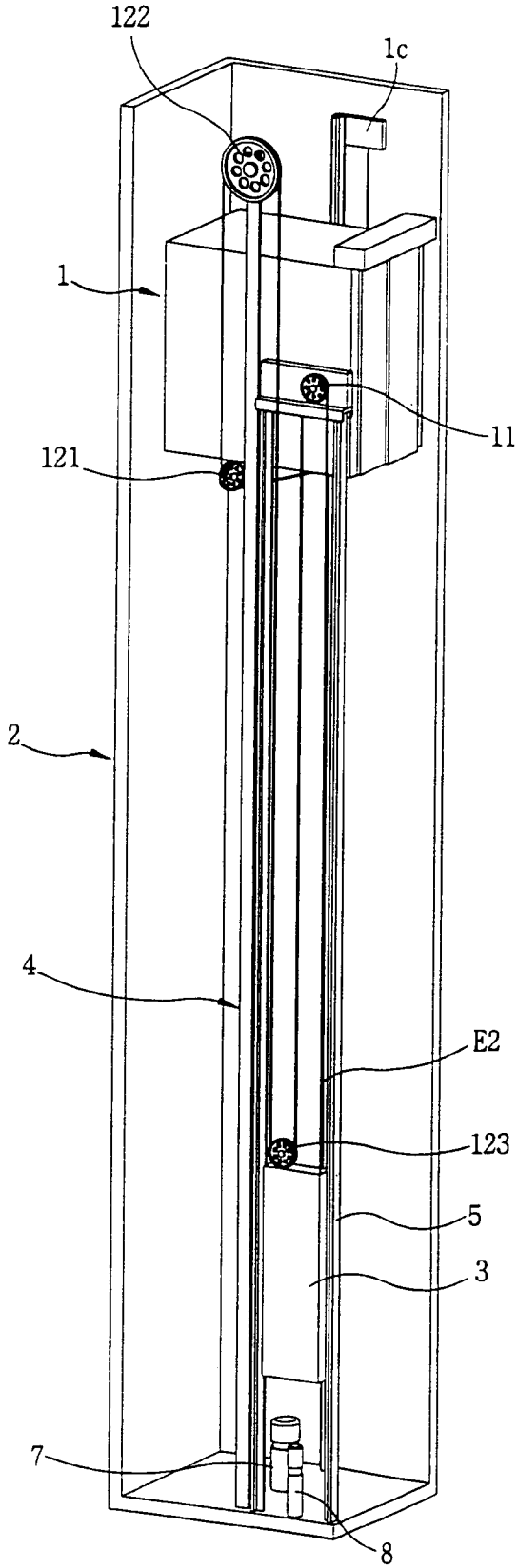
Figure 7:
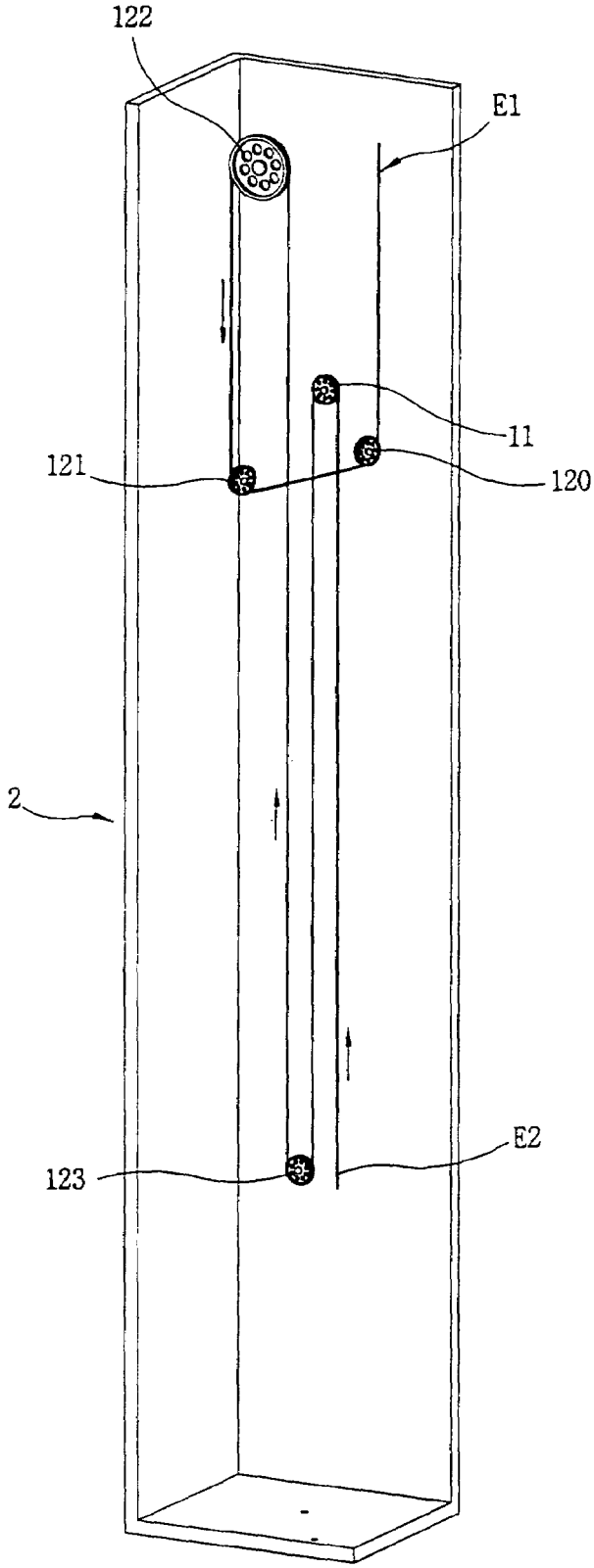
Figure 8:
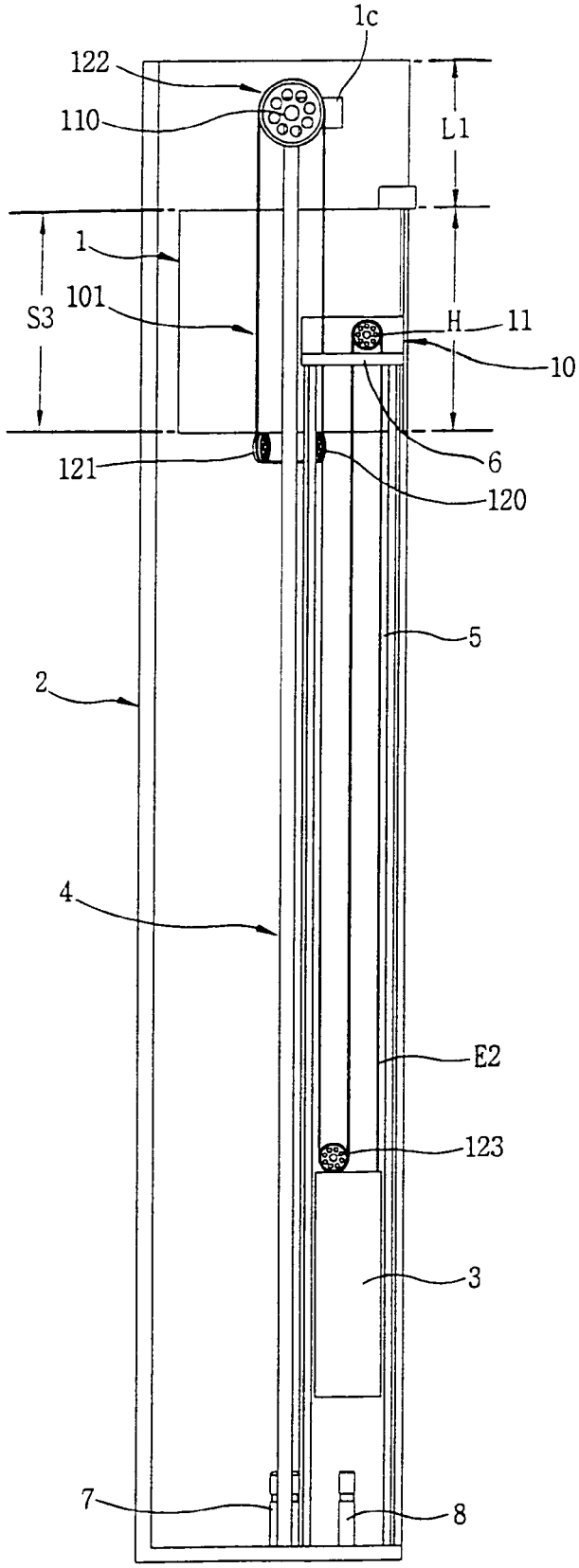
Figure 9:
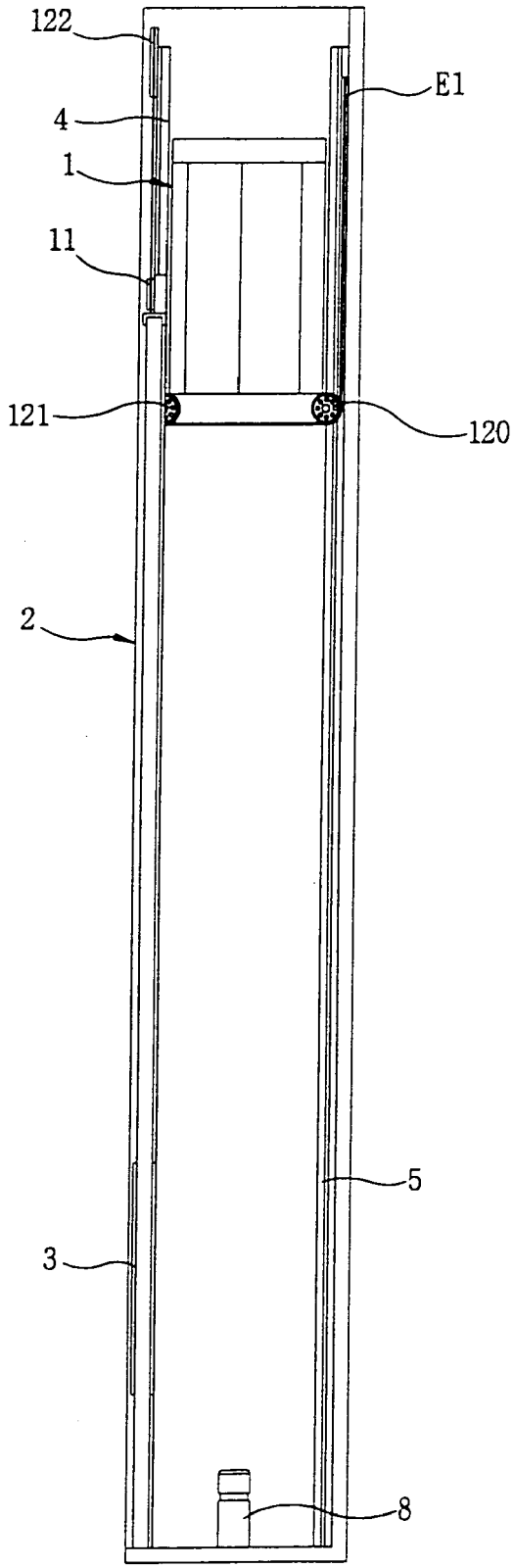
Figure 10:
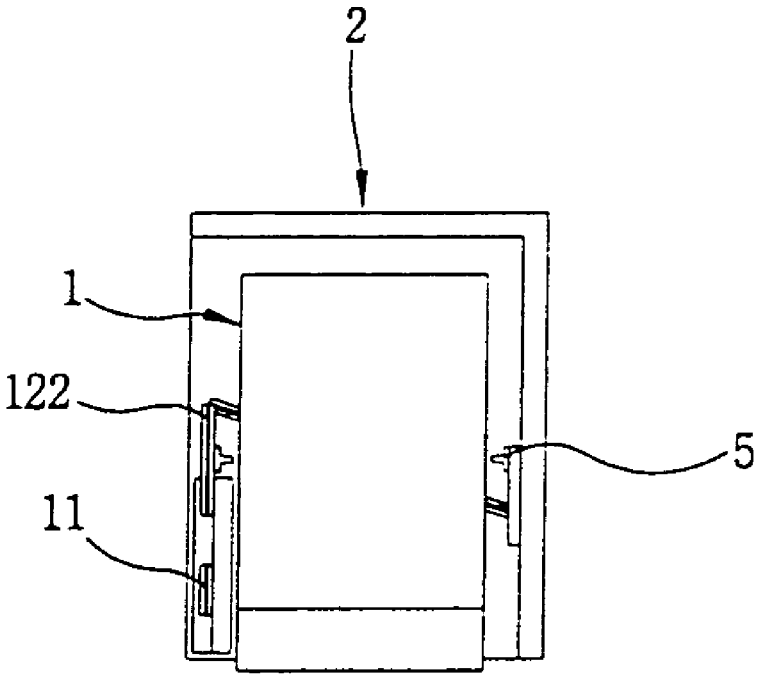
Figure 11:
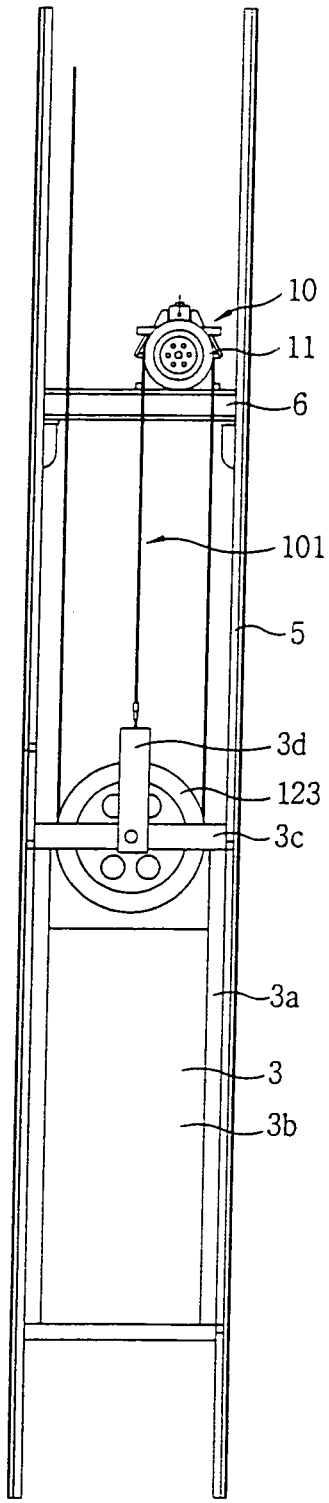

FIGS. 6 through 11 are views illustrating the construction of an elevator system without a machine room by cutting away a wall of a hoistway according to a second embodiment of the present invention, in which FIG. 6 is a perspective view of the same, FIG. 7 is a perspective view illustrating a rope arrangement structure, FIG. 8 is a front view of the same, FIG. 9 is a side view of the same, FIG. 10 is a plan view of the same, and FIG. 11 is an enlarged view illustrating a motor unit.

In the second embodiment of the present invention, the elevator car 1 is installed in such a manner that the upper ends of the counterweight guide rails 5 are positioned in the upper occupying region S3 by the width of the overall length H in which the elevator car 1 is positioned at the highest floor of the hoistway 2. In addition, the built-in winding apparatus 10 installed at the reinforcing installation member 6 fixed at the upper ends of the counterweight guide rails 5 is installed in the upper lower region in the upper occupying region S3.

Therefore, when the elevator car 1 is moved to the highest floor, the upper surface of the elevator car 1 passes through the upper portion of the counterweight guide rail 5 and arrives at the highest floor.

Here, an upper marginal length L1 is needed between the elevator car 1 and the upper portion of the hoistway 2 for installing other elements such as a pulley, etc.

The motor roping unit 100 is implemented based on a 2:3 roping method and an under slung roping method. In the motor roping unit 100, one end of the rope 101 is connected with the fixing portion 1*c* formed at an upper portion of the hoistway 2, and as the fixing portion 1*c*, a fixing member which is fixed at an upper end of the elevator car guide rail 4 or on an inner surface of the hoistway 2 or between the upper portion of one elevator car guide rail 4 and the inner surface of the hoistway 2 is used. A fixing member such as an anchor bolt, etc. is fixed at an inner surface of the hoistway 2 for stably fixing the rope, so that the end portion of the rope 101 is fixed by the fixing member.

One end of the rope 101 is fixed at the fixing member 1*c*, and pulleys 120 and 121 are fixed at both side intermediate portions of the lower surface of the elevator car 1, and the rope 101 is wound onto the lower portions of the pulleys 120 and 121 based on a under slung roping method. The pulley 122 is fixed at an upper end portion of the other elevator car guide rail 4, and the rope 101 is moved upwardly and is wound onto an upper outer circumferential surface of the pulley 122, and then the rope 101 is moved downwardly and is wound onto a lower outer surface of the pulley 123 fixed at an upper intermediate portion of the counterweight 122, and the rope 101 is moved upwardly and is wound onto an upper outer circumferential portion of the driving sheave 11 of the built-in winding apparatus 10, and then is downwardly moved and fixed at the upper end of the counterweight 3.

In the second embodiment of the present invention shown in FIGS. 5 through 11, the pulleys 120 and 121 are installed at the lower portion of the elevator car 1, and the rope 101 is wound onto the pulleys 120 and 121 by an under slung roping method, so that it is possible to minimize the over head space of the elevator car 1.

As shown in FIG. 11, in the counterweight 3, a counterweight material 3*b* is engaged to a frame 3*a*, and the engaging portion 3*c* of the pulley 123 is fixed at an upper portion of the frame 3*a*, and one end of the rope 101 is fixed at the connection portion 3*d* fixed at an intermediate portion of the engaging portion 3*c*.

Figure 12:
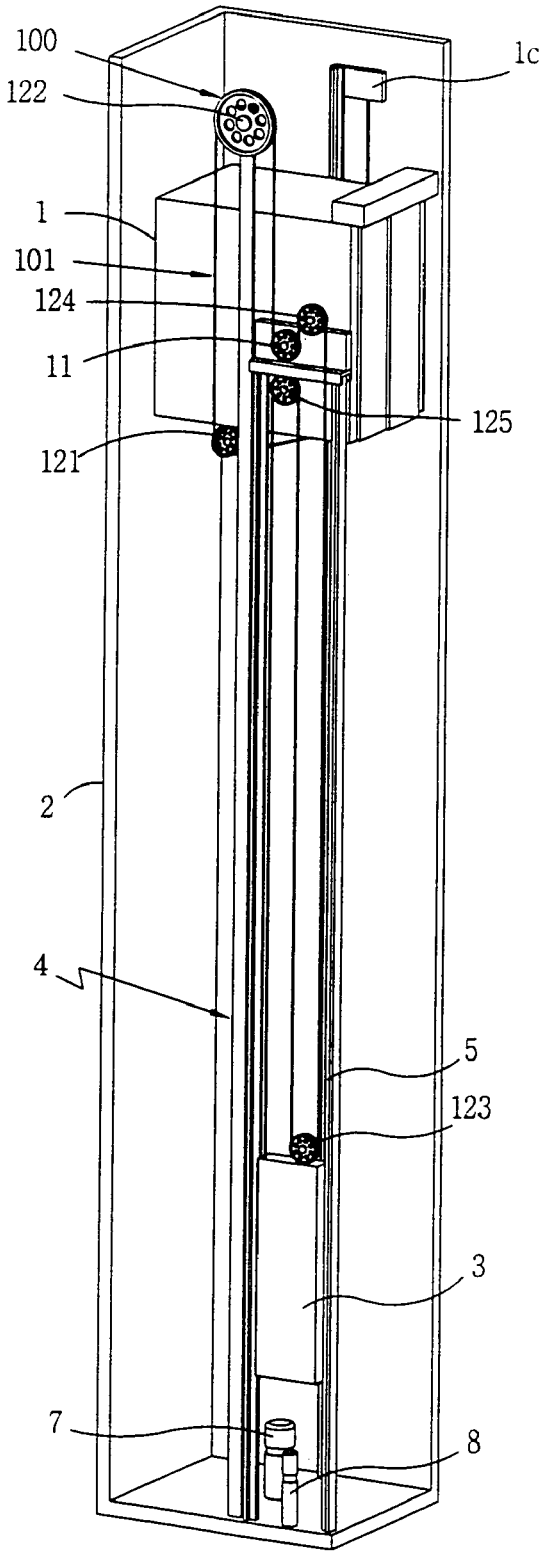
Figure 13:
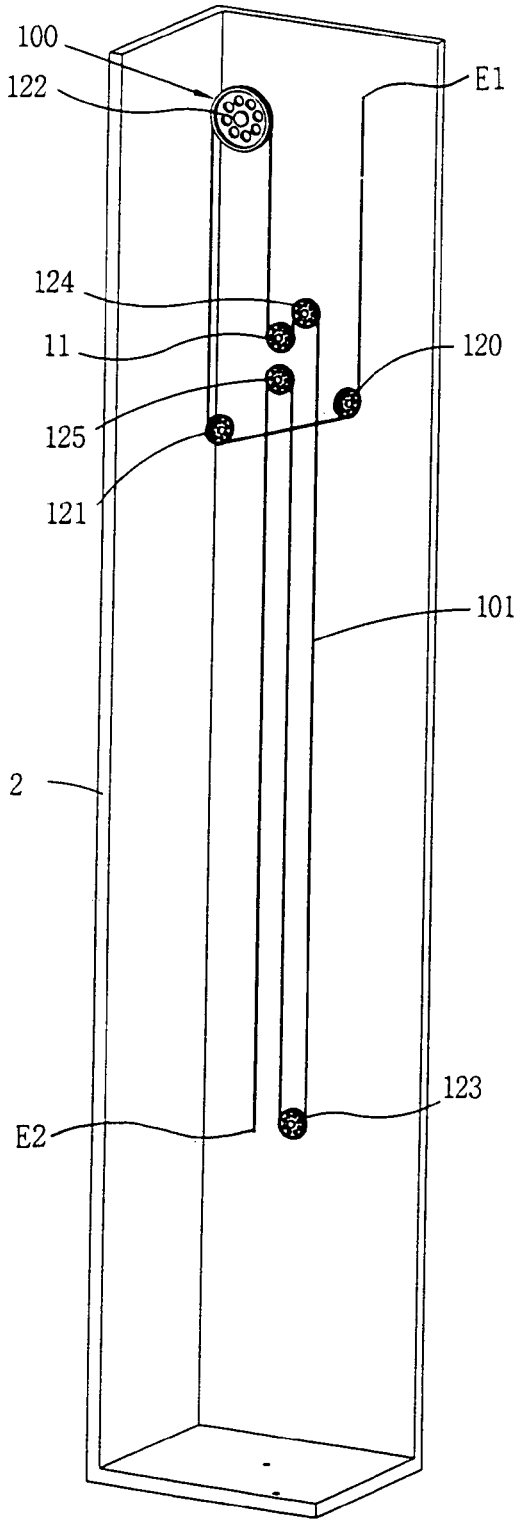
Figure 14:
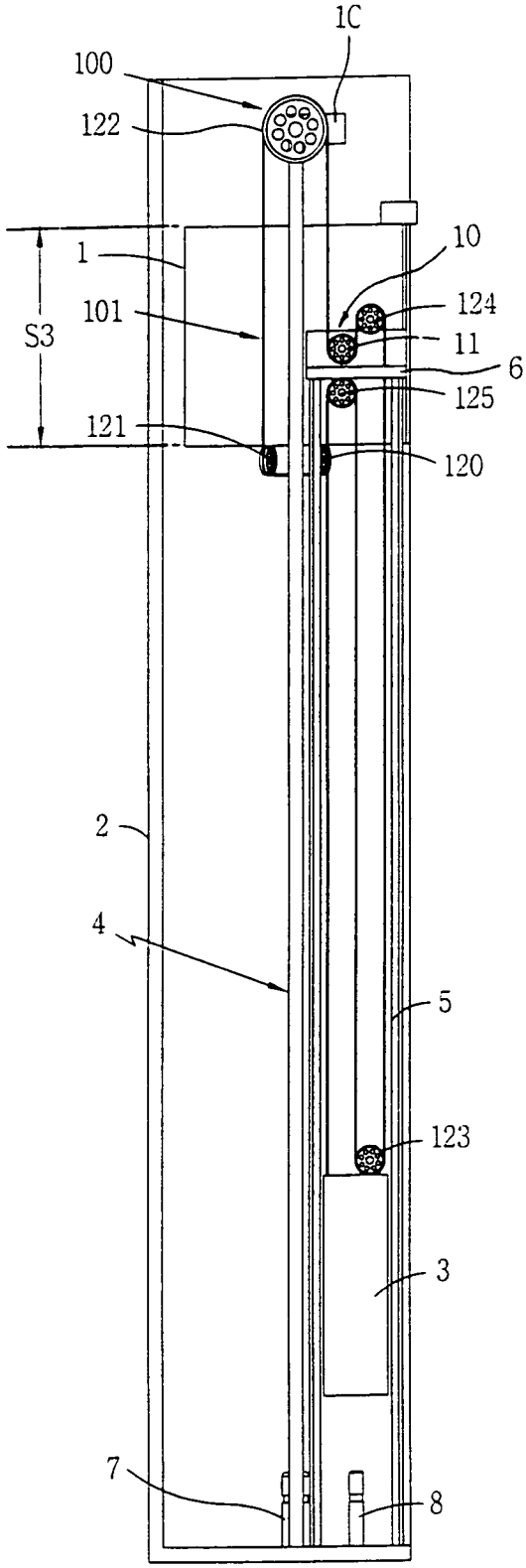
Figure 15:
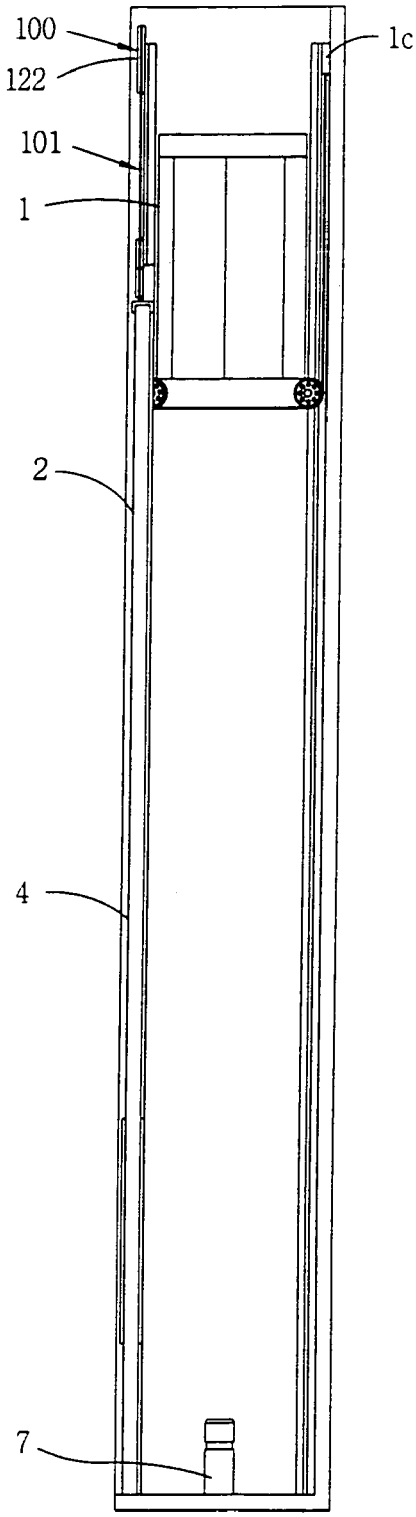
Figure 16:
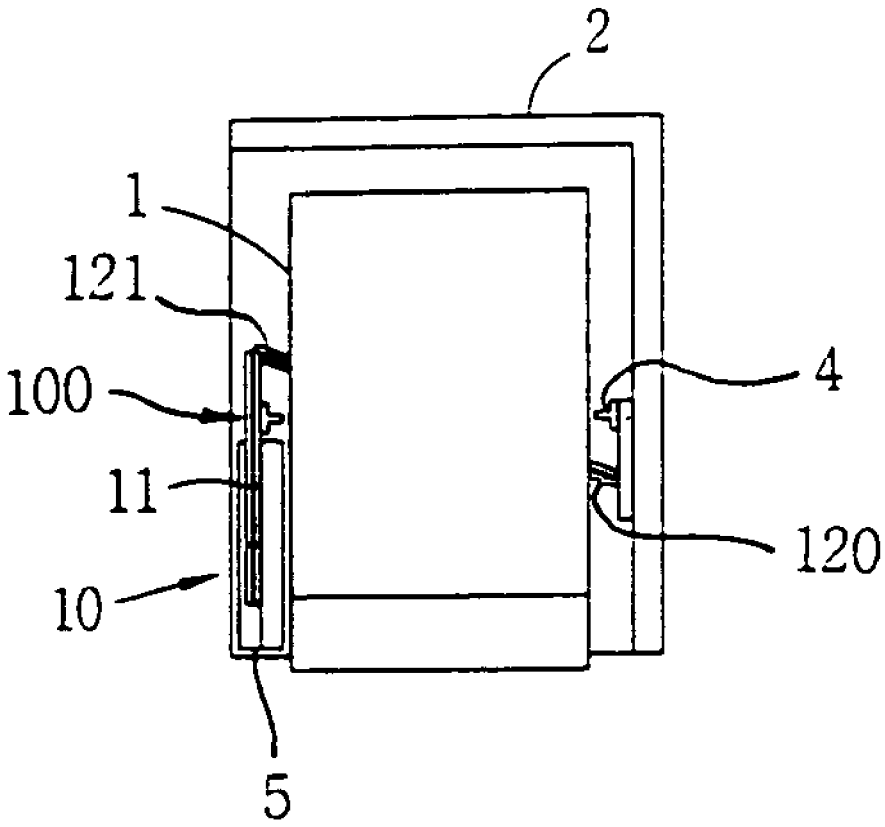
Figure 17:
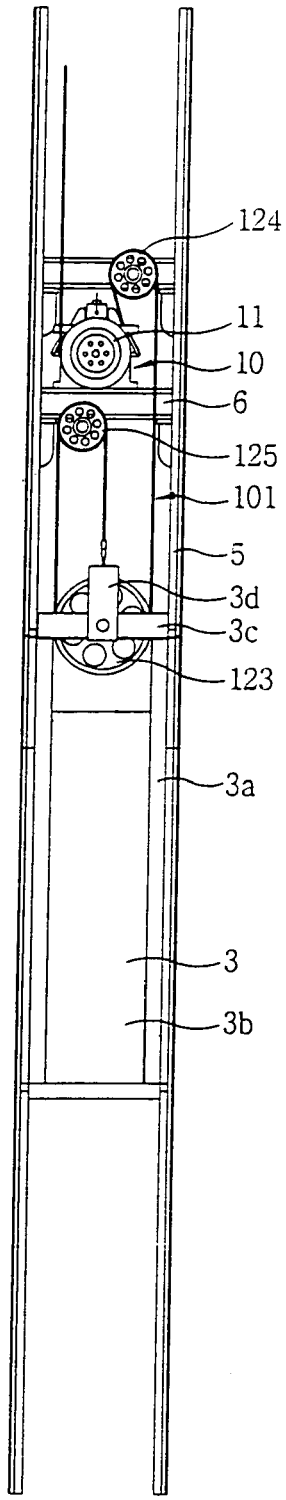

FIGS. 12 through 17 are views illustrating the construction of an elevator system without a machine room by cutting away a wall of a hoistway according to a third embodiment of the present invention, in which FIG. 12 is a perspective view of the same, FIG. 13 is a perspective view illustrating a rope arrangement structure, FIG. 14 is a front view of the same, FIG. 15 is a side view of the same, FIG. 16 is a plan view of the same, and FIG. 17 is an enlarged view of a motor unit.

In the third embodiment of the present invention, the elevator car 1 is installed in such a manner that the upper end of the counterweight guide rail 5 is positioned in an upper occupying region S3 of the hoistway 2, and the built-in winding apparatus 10 installed at the reinforcing installation member 6 fixed at the upper ends of the counterweight guide rails 5 is positioned in the upper region of the upper occupying region S3, so that the upper surface of the elevator car 1 arrives at the highest floor through the upper end of the counterweight guide rail 5 when the elevator car 1 is moved to the highest floor.

As shown in FIGS. 6 through 11, the motor roping unit 100 is implemented based on a 2:3 roping method and a under slung roping method like the second embodiment of the present invention, but the roping structure is different.

In the motor roping unit 100, one end of the rope 101 is fixed at the fixing portion 1*c*, and the pulleys 120 and 121 are fixed at both side intermediate portions of the elevator car 1, and the rope 101 is wound onto the pulley 120 and 121 by a under slung roping method. The pulley 122 is fixed at the upper end portion of another elevator car guide rail 4, and then the rope 101 is upwardly moved and is wound onto an upper outer circumferential surface of the pulley 122. The pulley 124 is fixed at the upper portion of the driving sheave 11 of the built-in winding apparatus 10 in a radial direction, and the rope 101 downwardly extended from the conversion pulley 122 is connected in a S-shape with a slight gradient with respect to the driving sheave 11 and the pulley 124, and the rope 101 moved downwardly is wound onto a lower outer circumferential surface of the pulley 123 fixed at the upper portion of the counterweight 3, and the rope 101 upwardly moved is wound onto an upper outer surface of the pulley 125 fixed at the lower portion of the driving sheave 11 of the built-in winding apparatus 10, and one end of the rope 101 downwardly moved is fixed at the upper end of the counterweight 3.

In the third embodiment of the present invention shown in FIGS. 12 through 17, the rope is wound based on a 2:3 roping method like the second embodiment of the present invention shown in FIGS. 6 through 11. The upper end point E1 of the rope 101 is the upper end fixing portion 1*c* of the hoistway 2, and the lower end point E2 is the upper end of the counterweight 3. The detailed roping structure is different.

Figure 18:
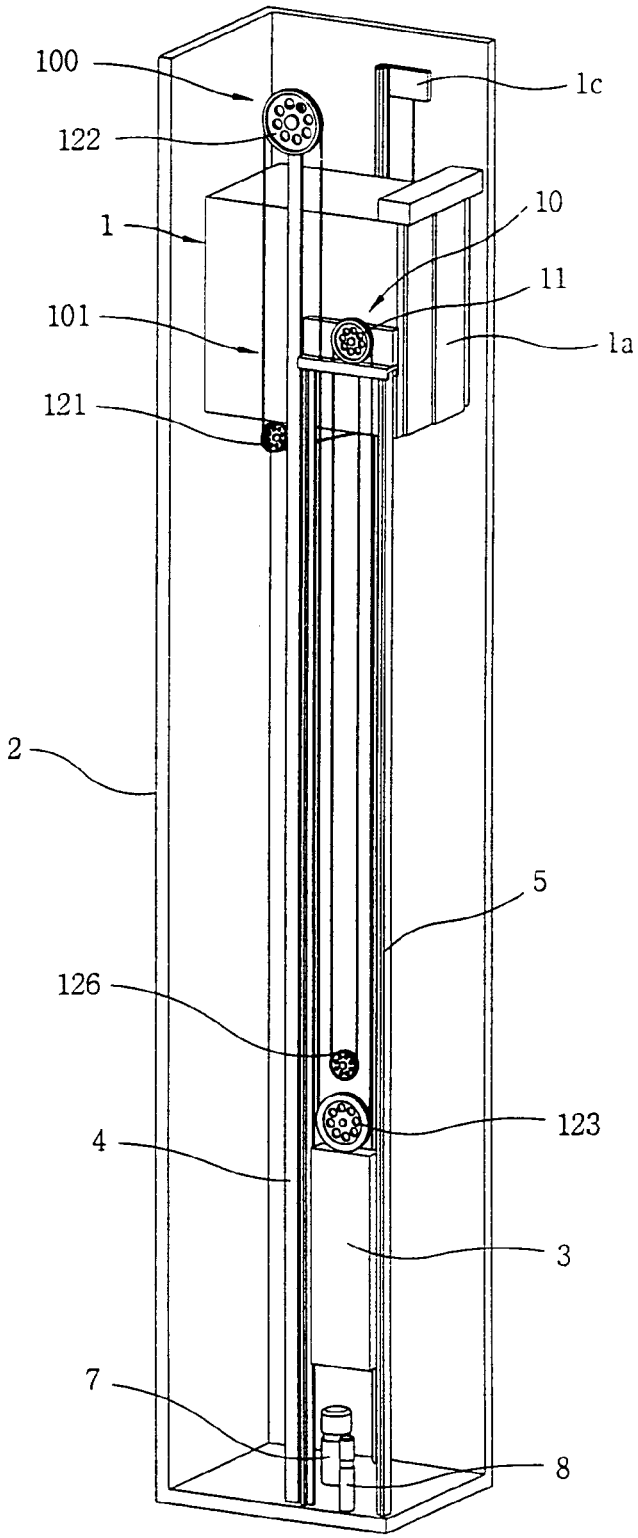
Figure 19:
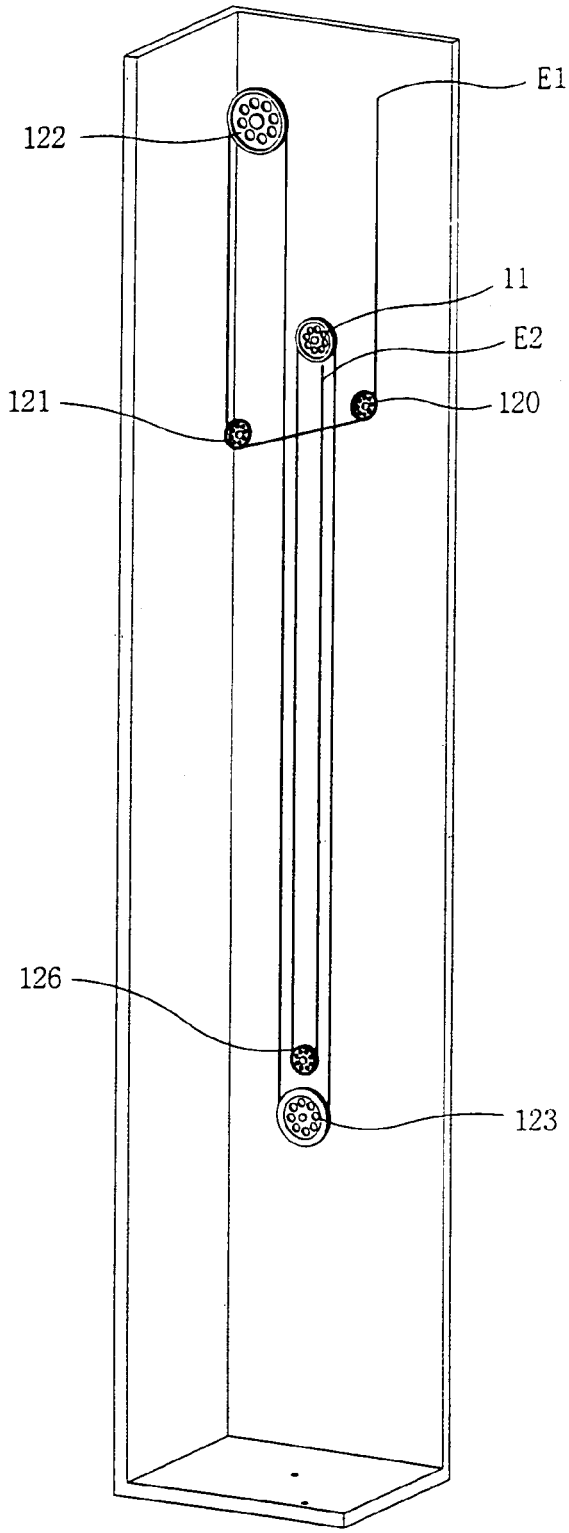
Figure 20:
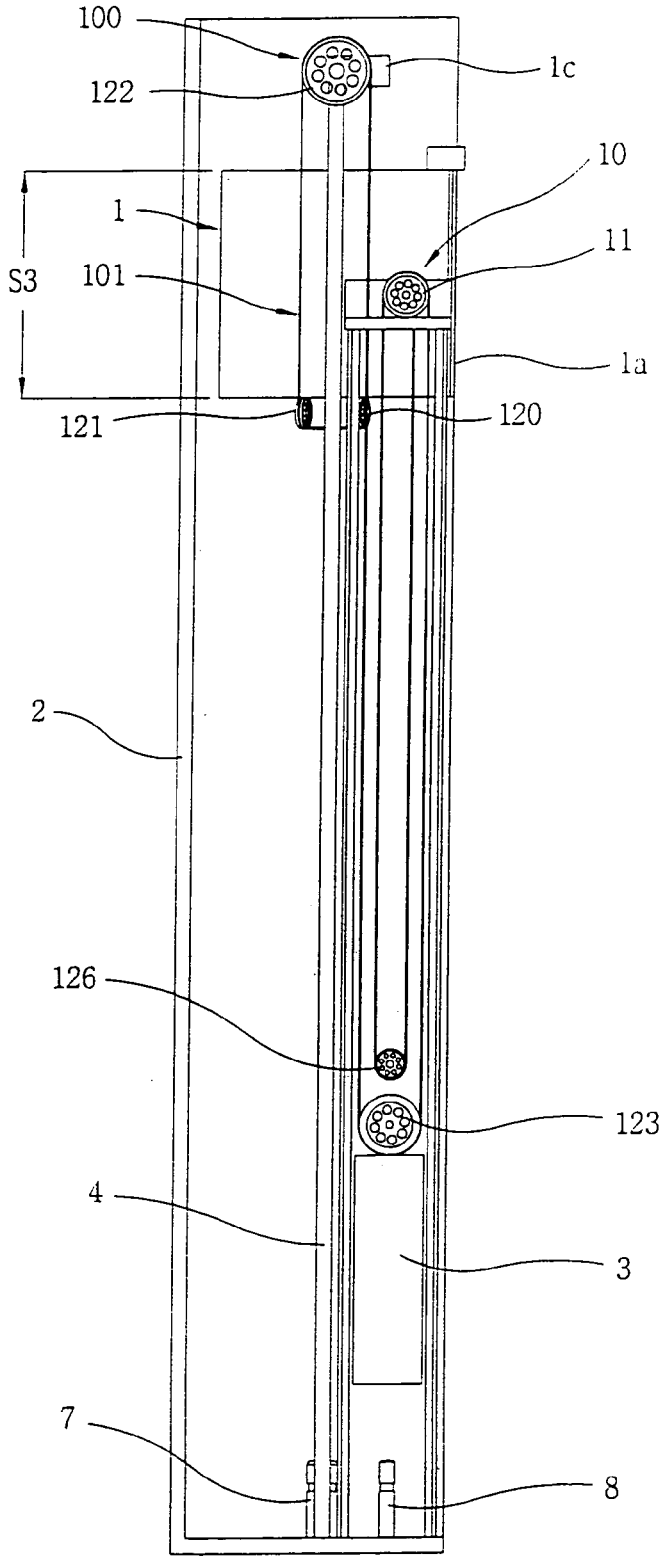
Figure 21:
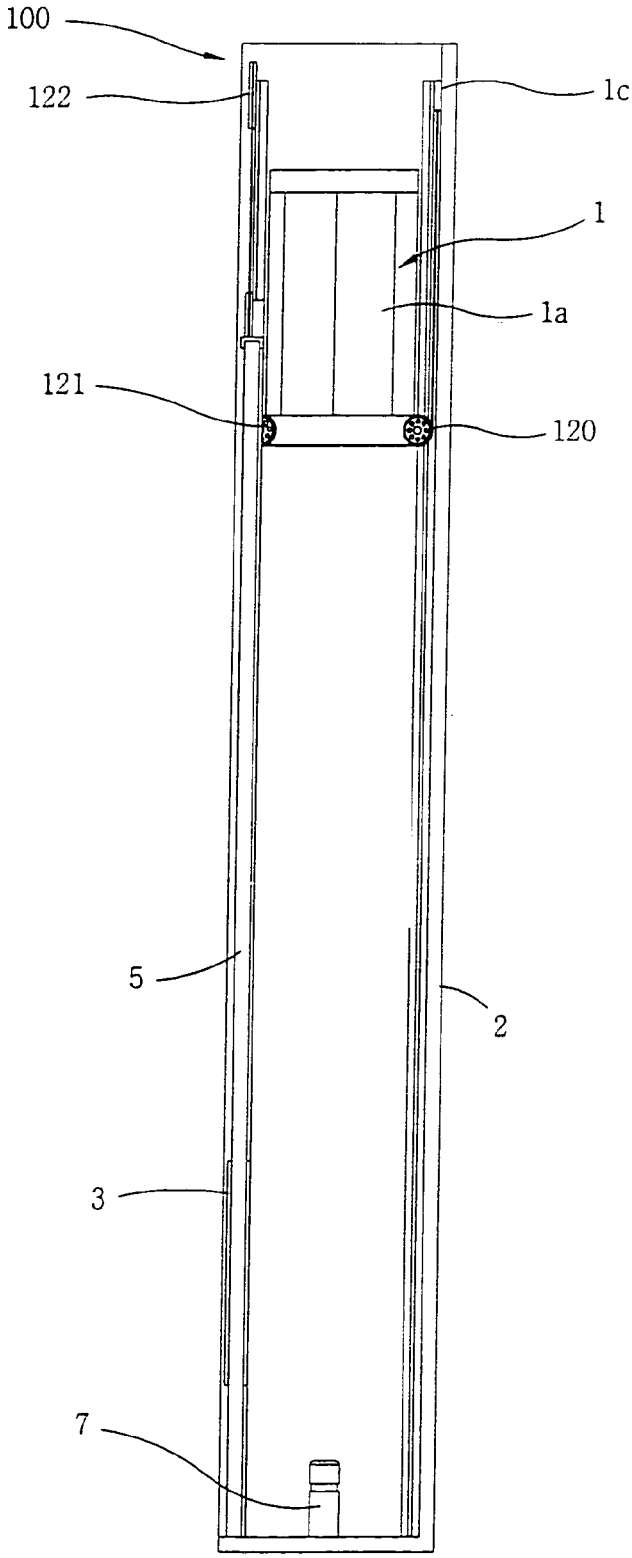
Figure 22:
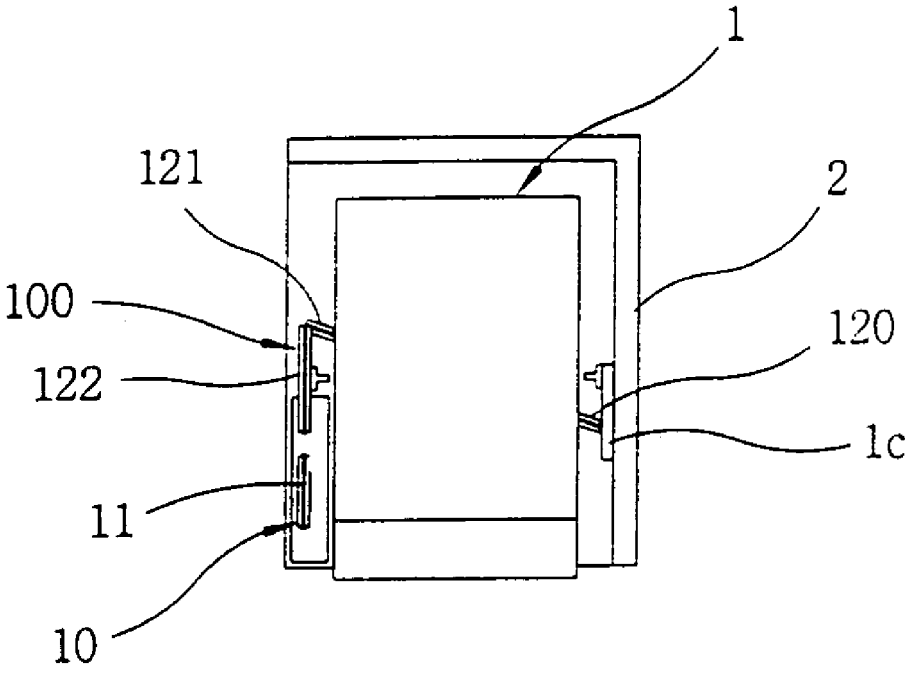
Figure 23:
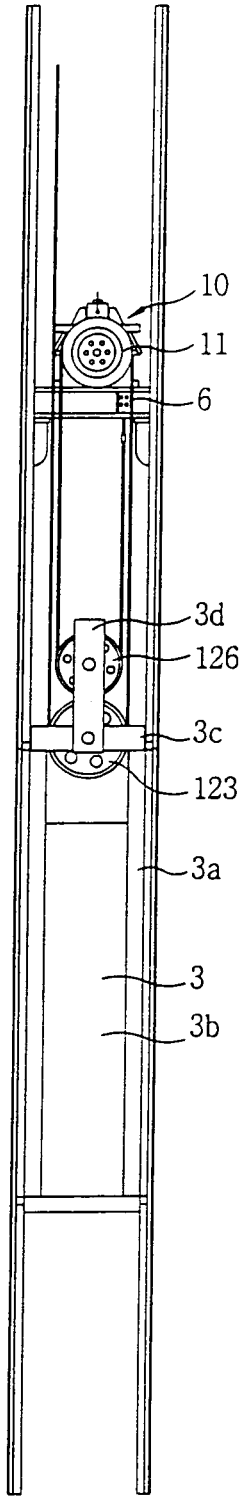

FIGS. 18 through 23 are views illustrating the construction of an elevator system without a machine room by cutting away a wall of a hoistway according to a fourth embodiment of the present invention, in which FIG. 18 is a perspective view of the same, FIG. 19 is a perspective view illustrating a rope arrangement structure, FIG. 20 is a front view of the same, FIG. 21 is a side view of the same, FIG. 22 is a plan view of the same, and FIG. 23 is an enlarged view of a motor unit.

In the fourth embodiment of the present invention shown in FIGS. 18 through 23, the elevator car 1 is installed in such a manner that the upper end of the counterweight guide rail 5 is positioned in the upper occupying region S3 of the hoistway 2, and the built-in winding apparatus 10 installed at the reinforcing installation member 6 fixed at the upper portion of the counterweight guide rails 5 are positioned in the upper side region of the upper occupying region S3. When the elevator car 1 is moved to the highest floor, the upper surface of the elevator car 1 passes through the upper end of the counterweight guide rail 5 and arrives at the highest floor.

The motor roping unit 100 is implemented by a 2:4 roping method and a under slung roping method. In the motor roping unit 100, the upper end point E1 of the rope 101 is a fixing portion 1*c* formed at the upper portion of the hoistway 2, and the lower end point E2 becomes the reinforcing installation member 6.

In the motor roping unit 100, one end of the rope 101 is fixed at the fixing portion 1*c* formed at the upper portion of the hoistway 2, and the pulleys 120 and 121 are fixed at lower both side intermediate portions of the elevator car 1, and the rope 101 is wound onto the pulleys 120 and 121 by a under slung roping method, and the pulley 122 is fixed at the upper end of another elevator car guide rail 4, and the rope is upwardly moved and is wound onto the upper outer circumferential surface of the pulley 122, and then the rope 101 downwardly moved is wound onto the outer surface of the pulley 123 fixed at an upper intermediate portion of the counterweight 3, and the rope 101 upwardly moved is wound onto an outer surface of the driving sheave 11 of the built-in winding apparatus 10, and the rope 101 downwardly moved is wound onto the outer surface of the pulley 126 engaged at the pulley connection portion 3*d* of the counterweight 3 so that the rope 101 is positioned on the pulley 123, and then the rope 101 upwardly moved is fixed at the reinforcing installation member 6.

Figure 24:
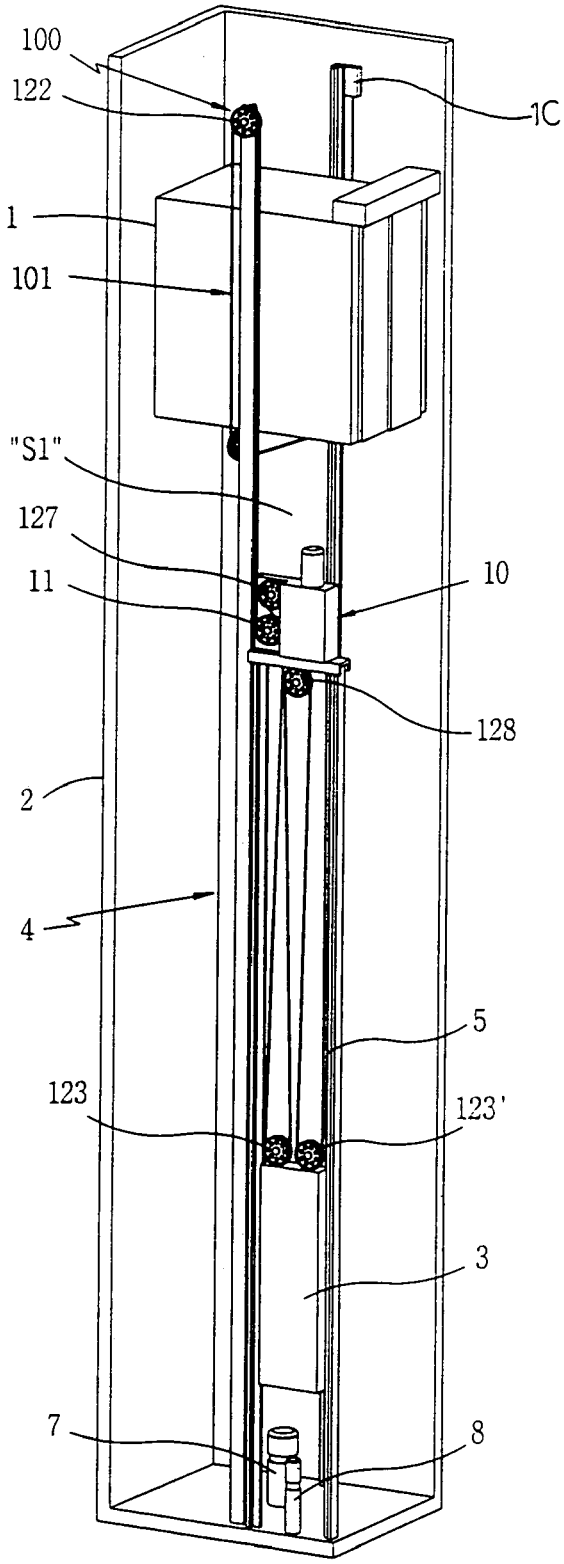
Figure 25:
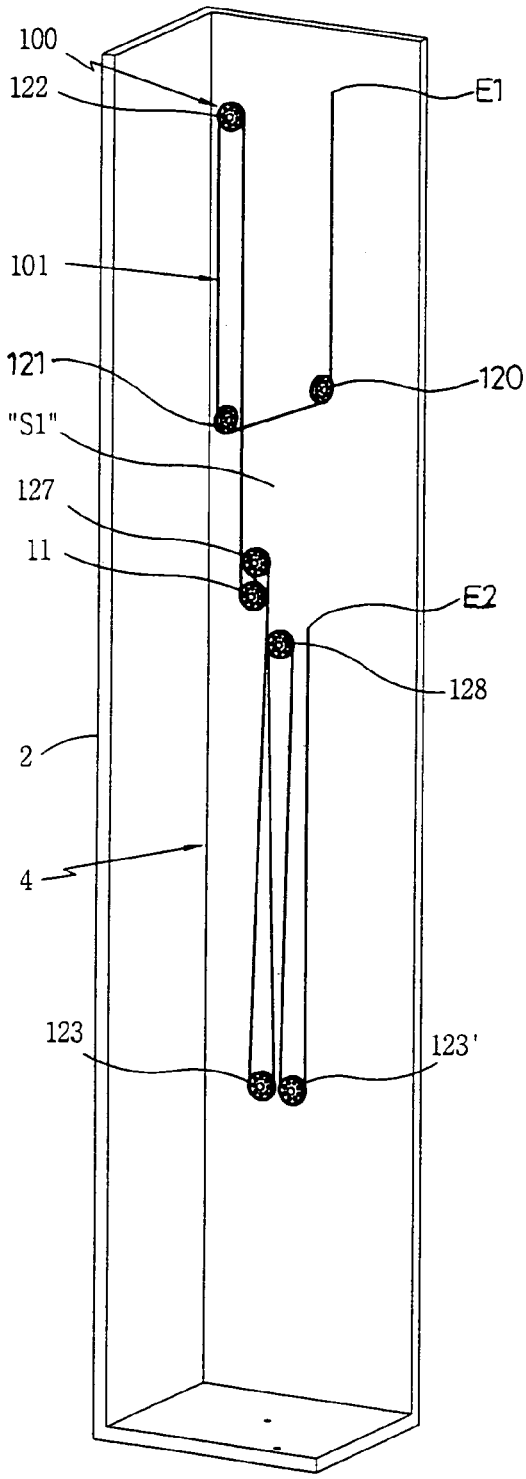
Figure 26:
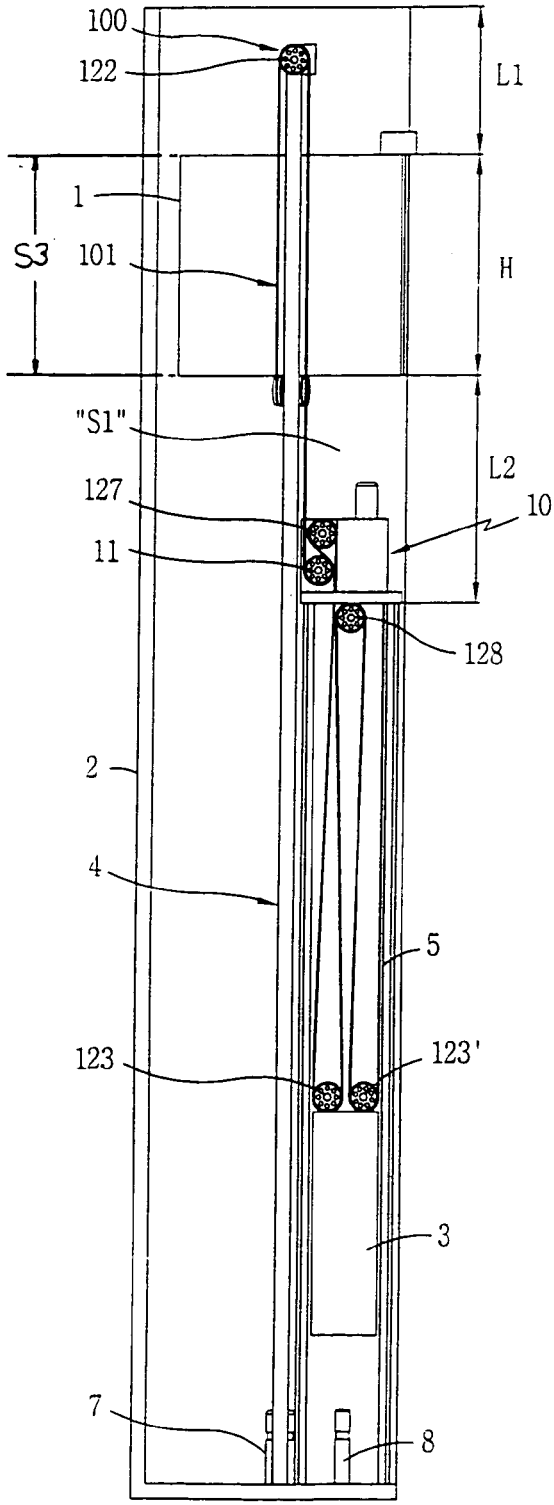
Figure 27:
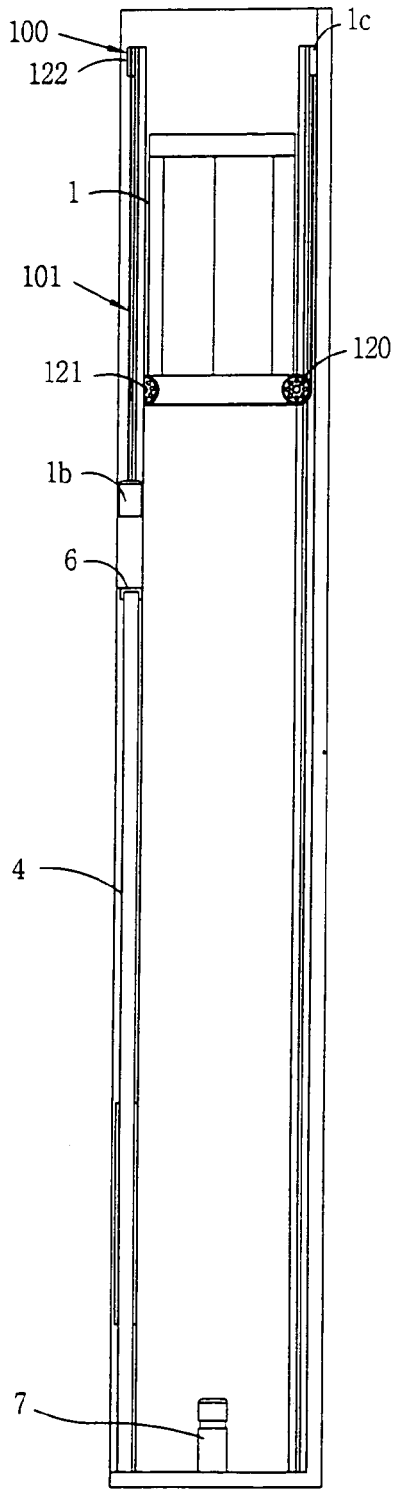
Figure 28:
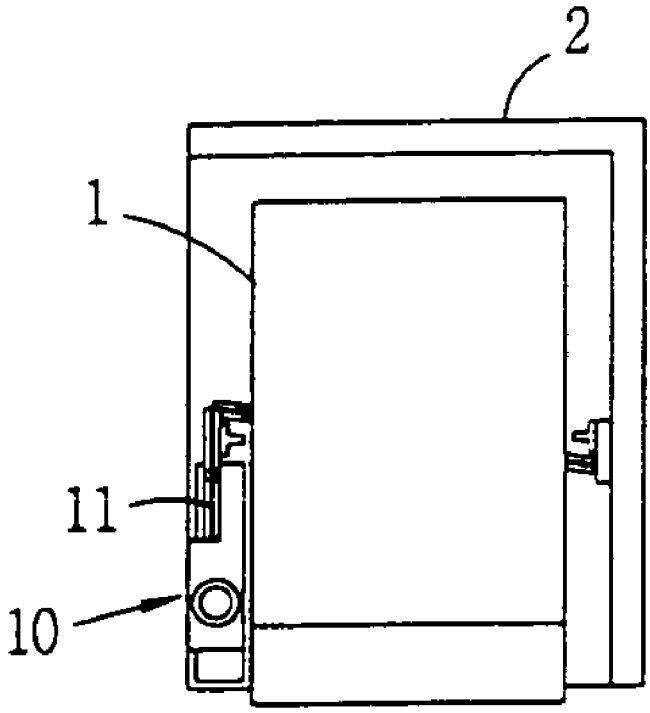

FIGS. 24 through 28 are views illustrating the construction of an elevator system without a machine room by cutting away a wall of a hoistway according to a fifth embodiment of the present invention, in which FIG. 24 is a perspective view of the same, FIG. 25 is a perspective view illustrating a rope arrangement structure, FIG. 26 is a front view of the same, FIG. 27 is a side view of the same, and FIG. 28 is an enlarged view illustrating a motor unit.

In the fifth embodiment of the present invention, the motor roping unit 100 is implemented by a 2:4 roping method and a under slung roping method. The upper end point E1 of the rope 101 is the fixing portion 1*c* formed at the upper portion of the hoistway 2, and the lower end point E2 is the reinforcing installation member 6 like the fourth embodiment of the present invention shown in FIGS. 18 through 23. The detailed roping structure is different.

In the fifth embodiment of the present invention, in the motor roping unit 100, one end of the rope 101 is fixed at the fixing portion formed at the upper portion of the hoistway 2, and the pulleys 120 and 121 are fixed at lower both side intermediate portions of the elevator car 1, and the rope 101 is wound onto the pulleys 120 and 121 by a under slung roping method, and the pulley 122 is fixed at the upper portion of another elevator car guide rail 4, and then the rope 101 is upwardly moved and is wound on an upper outer circumferential surface of the pulley 122, and the pulley 127 is engaged at the driving sheave 11 of the built-in winding apparatus 10, and the rope 101 is wound onto the driving sheave 11 and the pulley 127 in a S-shape, and the pulleys 123 and 123' are fixed at the upper portion of the counterweight 3, and the rope 101 extended from the pulley 127 is wound onto an outer circumferential surface of the pulley 123, and the rope is wound onto the outer circumferential surface of the pulley 128 fixed at the intermediate portion of the reinforcing installation member 6 of the built-in winding apparatus 10. The rope 101 downwardly moved is wound onto the outer surface of the pulley 123' of the counterweight 3, and one end of the rope 101 is fixed at a portion of the reinforcing installation member 6.

In the elevator without a machine room according to the above-described embodiments of the present invention, since the driving sheave 11 is rotated by a driving force of the built-in winding apparatus 10, when the elevator car 1 is lowered by the driving force applied by the rope, the counterweight 3 is lifted, and on the contrary when the elevator car 1 is lifted, the counterweight 3 is lowered.

In addition, in the conventional art, since the machine room is installed outside a building, an external appearance of the building is bad. However, in the present invention, it is possible to enhance an external appearance of the building by removing the machine room and thereby broadening a design choice range of the building.

In the present invention, the machine room is removed. In the case that there is a building height limit in a certain region, it is possible to build a building without having a height increased by the height of the machine room.

Since the built-in winding apparatus like the winding apparatus having a thin thickness such as an ECODISC is used, the elevator system is light compared to the conventional elevator using the typical winding apparatus formed of a deceleration motor and a sheave engaged to the shaft of the same. In addition, a smaller installation space is used, and the fabrication cost and maintenance cost are significantly decreased.

Since the counterweight guide rails which guide and support the counterweight are shorter than the elevator car guide rails which guide and support the elevator car, and the reinforcing installation member are installed across the counterweight guide rails, the counterweight guide rails are integral with the reinforcing installation member. The built-in winding apparatus is installed on the reinforcing installation member for moving the elevator car by a driving force transferred by the motor roping unit, so that the upper surface of the elevator car passes through the built-in winding apparatus and arrives at the highest floor. Therefore, the winding apparatus is strong with respect to the vibration, and the durability is increased. Since the space formed above the counterweight guide rails is large, the size of the winding apparatus is not limited. In addition, the design and installation adaptability is enhanced, and the maintenance is easy. The durability for the counterweight and vibration is enhanced.

In addition, in the case that the elevator car and the counterweight are roped by a 1:2 roping method, since the car side is a 1:1 roping method, noise may occur, and a decelerator may be needed. In addition, since the present invention adapts a one-side support method, the present invention may be applicable to a small size elevator. In addition, in the case that the 2:4 roping method is adapted to the present invention, the one-side support method is not used, the applicable range is more increased. In this case, the elevator car side is roped by a 2:1 roping method, a deceleration effect is obtained. Therefore, a direct driving method winding apparatus may be adapted. Since the load of the elevator car is distributed to two elevator car guide rails, the elevator system without a machine room is stable, and the durability of the same is enhanced.

In addition, the elevator car is roped by a under slung roping method. In another embodiment of the present invention, a 2:3 roping method is adapted partially. The conversion pulley fixed at the reinforcing installation member of the winding apparatus may be adapted as a winding sheave, so that it is possible to decrease the number of the conversion pulleys. In the present invention, since 180 degree winding angle of the winding sheave is obtained without using an additional pulley, the number of the pulleys is significantly decreased, and the counterweight of the balance counterweight is 15 times based on a partial 2:1 roping method. Therefore, there is much advantages compared to the 2:4 roping method.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. An elevator system without a machine room comprising:

a hoistway having a pair of elevator car guide rails and a pair of counterweight guide rails, the counterweight guide rails being shorter than the elevator guide rails;

an elevator car movable up and down along the elevator car guide rails;

a counterweight movable up and down along the counterweight guide rails;

roping means for suspending said elevator car and said counterweight; and a winding apparatus engaged with said roping means for moving said roping means for thereby moving said elevator car;

wherein said winding apparatus is installed on an installation member fixed on upper portions of the counterweight guide rails at a position lower than an upper portion of said elevator car when said elevator car is positioned at a highest floor of said hoistway.

2. The elevator system of claim 1, wherein the upper portions of the counterweight guide rails are lower than a lower portion of the elevator car when the elevator car is positioned at the highest floor of the hoistway.

3. The elevator system of claim 1, wherein pulley means engaging said roping means are installed in an upper marginal space of the hoistway formed between the elevator car when the elevator car is positioned at the highest floor of the hoistway and an upper portion of the hoistway.

4. The elevator system of claim 1, wherein the upper portions of the counterweight guide rails are positioned between an upper portion and a lower portion of the elevator car when the elevator car is positioned at the highest floor of the hoistway.

5. The elevator system of claim 1, wherein said roping means drives the elevator car having a relatively longer movement stroke, and the counterweight having a smaller movement stroke.

6. The elevator system of claim 1, wherein one end of said roping means is fixed at a fixing portion formed at an upper portion of the hoistway, and a pair of pulleys are fixed at lower intermediate portions of the elevator car.

7. The elevator system of claim 1, wherein one end of said roping means is fixed at a lower portion of a side of the elevator car, and the other end of said roping means is fixed at the installation member.

8. The elevator system of claim 1, wherein one end of said roping means is fixed at a fixing portion formed at an upper portion of the hoistway, and the other end of said roping means is fixed at an upper portion of the counterweight.

9. The elevator system of claim 8, wherein said fixing portion is an upper portion of one of the elevator car guide rails.

10. The elevator system of claim 8, wherein said fixing portion is a fixing member fixed at an inner wall surface of the hoistway.

11. The elevator system of claim 8, wherein said fixing portion is a fixing member fixed between upper portions of the elevator car guide rails and an inner wall surface of the hoistway.

12. The elevator system of claim 1, wherein one end of said roping means is a fixing portion formed at an upper portion of the hoistway, and the other end of said roping means is the installation member.

13. The elevator system of claim 1, wherein said winding apparatus is a thin disc-type winding apparatus.

14. The elevator system of claim 1, wherein:

one end of said roping means is fixed at a fixing portion formed at a lower portion of the elevator car;

said roping means is upwardly moved from the fixing portion and is wound onto an upper outer surface of a first pulley fixed at an upper portion of one of the elevator car guide rails;

a second pulley is engaged at a driving sheave of the winding apparatus, and said roping means is wound from the first pulley onto the driving sheave and the second pulley in an S-shape;

a third pulley is fixed at an upper portion of the counterweight, and then said roping means is wound from the second pulley onto a lower outer surface of the third pulley;

said roping means is upwardly moved from the third pulley, and the other end of said roping means is fixed at the installation member for thereby implementing a 1:2 roping method.

15. The elevator system of claim 1, wherein said roping means is roped by a 2:3 roping method, and an under slung roping method.

16. The elevator system of claim 15, wherein:

one end of said roping means is fixed at a fixing portion formed at an upper portion of the hoistway;

a pair of first pulleys a re fixed at lower intermediate portions of the elevator car, and said roping means is wound from the fixing portion onto the first pulleys by the under slung roping method;

a second pulley is fixed at an upper portion of one of elevator car guide rails, and then said roping means is upwardly moved from the first pulleys and is wound onto an upper outer surface of the second pulley and then;

said roping means is downwardly moved from the second pulley and is wound onto an outer surface of a third pulley fixed at an upper intermediate portion of the counterweight;

said roping means is upwardly moved from the third pulley and is wound onto an upper outer surface of a driving sheave of the winding apparatus, and said roping means is then downwardly moved from the driving sheave;

the other end of said roping means is fixed at an upper portion of the counterweight.

17. The elevator system of claim 15, wherein:

one end of said roping means is fixed at a fixing portion formed at an upper portion of the hoistway;

a pair of first pulleys are fixed at lower intermediate portions of the elevator car, and said roping means is wound from the fixing portion onto a lower surface of the first pulleys by an under slung roping method;

a second pulley is fixed at an upper portion of one of the elevator car guide rails, and said roping means is upwardly moved from the first pulleys the and is wound onto an upper outer surface of the second pulley;

a third pulley is fixed at an upper portion of a driving sheave of the winding apparatus in a slanting direction, and said roping means downwardly moved from the second pulley is wound in an S-shape with a slight gradient with respect to the driving sheave and the third pulley;

said roping means downwardly moved from the third pulley is wound onto a lower outer surface of a fourth pulley fixed at an upper portion of the counterweight;

said roping means upwardly moved from the fourth pulley is wound onto an upper outer surface of a fifth pulley fixed at a lower portion of the driving sheave of the winding apparatus, and the other end of said roping means downwardly moved from the fifth pulley is fixed at the upper portion of the counterweight.

18. The elevator system of claim 1, wherein said roping means is roped by a 2:4 roping method, and an under slung roping method.

19. The elevator system of claim 18, wherein:

one end of said roping means is fixed at a fixing portion formed at an upper portion of the hoistway;

a pair of first pulleys are fixed at lower intermediate portions of the elevator car, and said roping means is wound from the fixing portion onto a lower outer surface of the first pulleys by an under slung roping method;

a second pulley is fixed at an upper portion of one of the elevator car guide rails, and said roping means is upwardly moved from the first pulleys and is wound onto an upper outer surface of the second pulley;

said roping means downwardly moved from the second pulley is wound onto a lower outer surface of a third pulley fixed at an upper intermediate portion of the counterweight, and said roping means upwardly moved from the third pulley is wound onto an upper outer surface of a driving sheave of the winding apparatus;

said roping means downwardly moved from the driving sheave is wound onto a lower outer surface of a fourth pulley fixed at an upper portion of the third pulley fixed to the counterweight; and then the other end of said roping means upwardly moved from the fourth pulley is fixed at the installation member.

20. The elevator system of claim 18, wherein:

one end of said roping means is fixed at a fixing portion formed at an upper portion of the hoistway;

a pair of first pulleys are fixed at lower intermediate portions of the elevator car, and said roping, means is wound from the fixing portion onto the first pulleys by an under slung roping method;

a second pulley is fixed at an upper portion of one of the elevator car guide rails, and said roping means is upwardly moved from the first pulleys and is wound onto an upper outer surface of the second pulley;

a third pulley is engaged at an upper portion of a driving sheave of the winding apparatus, and said roping means is wound from the second pulley onto the driving sheave and the third pulley in an S-shape;

a pair of fourth pulleys axe fixed at an upper portion of the counterweight, and said roping means moved downwardly from the third pulley is wound onto a lower outer surface of one of the fourth pulleys;

said roping means upwardly moved from one of the fourth pulleys is wound onto an upper outer surface of a fifth pulley fixed at a lower intermediate portion of the installation member;

said roping means downwardly moved from the fifth pulley is wound onto a lower outer surface of the other one of the fourth pulleys; and then the other end of said roping means upwardly moved from the other one of the fourth pulleys is fixed at a lower portion of the installation member.

21. The elevator system of claim 1, wherein the winding apparatus is positioned between a lower portion of said elevator car when said elevator car is positioned at the highest floor of the hoistway, and an upper surface of the counterweight when the counterweight is positioned at the lowest portion of the hoistway.

22. The elevator system of claim 1, wherein the winding apparatus is positioned in an installation region of a front portion or a rear portion in an interior of the hoistway formed as a traveling marginal space, and the counterweight is positioned below the winding apparatus.

23. An elevator system without a machine room, comprising:

a hoistway having a pair of elevator car guide rails and a pair of counterweight guide rails, the counterweight guide rails being shorter than the elevator guide rails;

an elevator car movable up and down along the elevator car guide rails;

a counterweight movable up and down along the counterweight guide rails;

roping means for suspending said elevator car and said counterweight; and a winding apparatus engaged with said roping means for moving said roping means for thereby moving said elevator car;

wherein said winding apparatus is installed on an installation member fixed on upper portions of the counterweight guide rails at a position lower than an upper portion of said elevator car when said elevator car is positioned at a highest floor of said hoistway, and a movement stroke of the counterweight is shorter than a movement stroke of the elevator car.

24. The elevator system of claim 23, wherein said roping means drives the elevator car having a relatively longer movement stroke, and the counterweight having a smaller movement stroke at the same cycle, and is roped by a roping method.

25. The elevator system of claim 23, wherein said roping means is roped by a 2:3 roping method.

26. The elevator system of claim 25, wherein:

one end of said roping means is fixed at a fixing portion formed at an upper portion of the hoistway;

a pair of first pulleys are fixed at lower intermediate portions of the elevator car, and said roping means is wound from the fixing portion onto a lower surface of the first pulleys by an under slung roping method;

a second pulley is fixed at an upper portion of one of the elevator car guide rails, and said roping means is upwardly moved from the first pulleys the and is wound onto an upper outer surface of the second pulley;

a third pulley is fixed at an upper portion of a driving sheave of the winding apparatus in a slanting direction, and said roping means downwardly moved from the second pulley is wound in an S-shape with a slight gradient with respect to the driving sheave and the third pulley;

said roping means downwardly moved from the third pulley is wound onto a lower outer surface of a fourth pulley fixed at an upper portion of the counterweight;

said roping means upwardly moved from the fourth pulley is wound onto an upper outer surface of a fifth pulley fixed at a lower portion of the driving sheave of the winding apparatus, and the other end of said roping means downwardly moved from the fifth pulley is fixed at the upper portion of the counterweight.

* * * * *